US005084373A

United States Patent [19]

Watanabe et al.

[11] Patent Number: 5,084,373

[45] Date of Patent: Jan. 28, 1992

[54] LIGHT-SENSITIVE COLOR PHOTOGRAPHIC MATERIAL IMPROVED ON THE SHARPNESS AND GRAININESS THEREOF

[75] Inventors: Yoshikazu Watanabe; Yoshitaka Yamada; Toshihiko Kimura; Hidetaka Ninomiya, all of Tokyo, Japan

[73] Assignee: Konica Corporation, Tokyo, Japan

[21] Appl. No.: 635,796

[22] Filed: Dec. 31, 1990

Related U.S. Application Data

[63] Continuation of Ser. No. 403,994, Sep. 6, 1989, abandoned, which is a continuation of Ser. No. 151,696, Feb. 2, 1988, abandoned.

[30] Foreign Application Priority Data

Feb. 5, 1987 [JP] Japan ..... 62-23569
Jun. 23, 1987 [JP] Japan ..... 62-156103

[51] Int. Cl.[5] ..... G03C 7/20; G03C 7/26

[52] U.S. Cl. ..... 430/496; 430/505; 430/545; 430/551

[58] Field of Search ..... 430/496, 505, 551, 548, 430/545

[56] References Cited

U.S. PATENT DOCUMENTS

| | | | |
|---|---|---|---|
| 3,211,552 | 10/1965 | Chu et al. | 430/496 |
| 3,361,565 | 1/1968 | Umberger | 430/496 |
| 4,477,560 | 10/1984 | Katabashi et al. | 430/551 |
| 4,618,571 | 10/1986 | Ichijima et al. | 430/551 |
| 4,678,743 | 7/1987 | Yamada et al. | 430/551 |
| 4,741,994 | 5/1988 | Ichijima et al. | 430/551 |
| 4,766,058 | 8/1988 | Sampei et al. | 430/496 |
| 4,833,069 | 5/1989 | Hamada et al. | 430/496 |

*Primary Examiner*—Richard L. Schilling
*Attorney, Agent, or Firm*—Jordan B. Bierman

[57] ABSTRACT

A silver halide light-sensitive color photographic material improved on the sharpness and the graininess of images is disclosed. The photographic material of the invention comprises a support having thereon photographic component layers including a red-sensitive silver halide emulsion layer, a green-sensitive silver halide emulsion layer and a blue-sensitive silver halide emulsion layer, in which the photographic component layers have a total dry thickness of not more than 18 μm , and at least one of the photographic component layers contains a coupler capable of releasing a scavenger which is capable of scavenging the oxidation product of a color developing agent.

4 Claims, No Drawings

LIGHT-SENSITIVE COLOR PHOTOGRAPHIC MATERIAL IMPROVED ON THE SHARPNESS AND GRAININESS THEREOF

This application is a continuation of application Ser. No. 07/403,994 filed Sept. 6, 1989, now abandoned, which is a continuation of application Ser. No. 07/151,696, filed Feb. 2, 1988, now abandoned.

FIELD OF THE INVENTION

The present invention relates to a silver halide light-sensitive color photographic material, and more particularly to a silver halide light-sensitive color photographic material (hereinafter may be referred to as color light-sensitive material) which is highly sensitive and improved on the sharpness as well as on the graininess of images formed thereon.

BACKGROUND OF THE INVENTION

As a means to improve the quality, particularly, sharpness, of images formed on a color light-sensitive material, making the layers of the color light-sensitive material as much thin as possible has been studied. Especially in the case of a silver halide emulsion layer that is positioned closer to the support, because the scattering path of the light from the surface of the light-sensitive material is longer, the thinning of the layer by reducing the amount of the binder is known to be a useful means to improve the sharpness; as described in, e.g., Journal of the Optical Society of America, 58 (9), 1245–1256 (1968), and Photographic Science and Engineering, 16 (3), 181–191 (1972).

And as concrete means for thinning such layers, the reduction in the coating amount of gelatin, the reduction in the coating amount of couplers, the reduction in the amount of the high-boiling solvent for use in coupler dispersion, and the use of so-called polymer couplers, and the like are known.

The total dry thickness of the photographic component layers of an ordinary color light-sensitive material is mostly from 20 to 30 μm. However, it has been found that if the thickness is reduced to, for example, 18 μm or less, the color light-sensitive material, although improved on the sharpness, is deteriorated significantly in the graininess. This phenomenon is particularly significant where high-speed emulsion layers are thinned, and is construed to occur basically because the produced oxidation product of a developing agent, as soon as reacting with the coupler inside one layer, diffuses into another layer adjacent thereto to start coupling reaction thereinside, or bleaches other silver halide in the former layer, whereby the number of developing points is reduced, thus deteriorating the graininess. As a means to solve such the problem, the use of various scavengers to scavenge the oxidation product of a developing agent has been investigated. It has been found out, however, that such means, if adopted, is undesirable from the photographic characteristic point of view because it causes the color light-sensitive material to be deteriorated in the sensitivity as well as in the preservability.

SUMMARY OF THE INVENTION

It is an object of the present invention to provide a high-speed silver halide light-sensitive color photographic material which is improved on the graininess as well as on the sharpness.

As a result of our continued investigation, it has now been found that the above object of the present invention is accomplished by a silver halide light-sensitive color photographic material comprising a support having thereon photographic component layers comprising a red-sensitive silver halide emulsion layer, a green-sensitive silver halide emulsion layer and a blue-sensitive silver halide emulsion layer, in which the photographic component layers have a total dry thickness of not more than 18 μm, and at least one layer of the photographic component layers contains a coupler capable of releasing a scavenger for the oxidation product of a developing agent.

DETAILED DESCRIPTION OF THE INVENTION

The present invention is characterized by the above-mentioned photographic component layers containing in at least one layer thereof a coupler capable of releasing a scavenger for the oxidation product of a developing agent (hereinafter referred to as DSR coupler).

The above DSR coupler is a coupler capable of reacting with the oxidation product of a developing agent to thereby scavenge the oxidation product or a coupler capable of releasing the precursor of such a scavenger coupler.

Generally, the DSR coupler has the following Formula [I]:

Formula [I]

Coup—SC wherein Coup is a coupler residue capable of releasing SC by its reaction with the oxidation product of a color developing agent, and SC is a color developing agent's oxidation product scavenger or a precursor thereof which, after being released from Coup, is capable of scavenging the color developing agent's oxidation product by its oxidation-reduction reaction or coupling reaction therewith.

To explain further in detail the above compound, the coupler residue represented by the 'Coup' of Formula [I], generally, is an yellow coupler residue, a magenta coupler residue, a cyan coupler residue, or a substantially colorless coupler residue, and is preferably any one of those coupler residues having the following Formulas [II] through [VIII]:

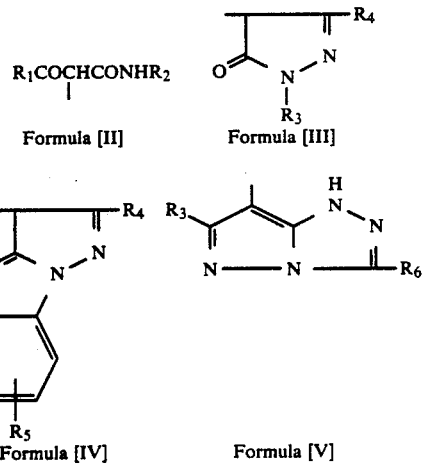

-continued

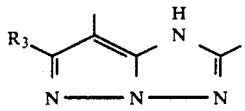

Formula [VI]

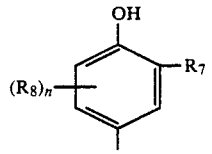

Formula [VII]

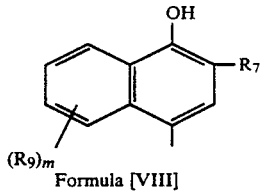

Formula [VIII]

In Formula [II], $R_1$ is an alkyl group, an aryl group or an arylamino group, and $R_2$ is an aryl group or an alkyl group.

In Formula [III], $R_3$ is an alkyl group or an acylamino group, and $R_4$ is an alkyl group, an acylamino group, an arylamino group, a phenylureido group or an alkylureido group.

In Formula [IV], R is as defined in the $R_4$ of Formula [III], and $R_5$ is an acylamino group, a sulfonamido group, an alkyl group, an alkoxy group or a halogen atom.

In Formulas [V] and [VI], a substituent $R_5$ is as defined in the $R_3$ of Formula [III], and R is an alkyl group or an aryl group.

In Formula [VII], R is an acylamino group, a carbamoyl group or a phenylureido group, and $R_5$ is a halogen atom, an alkyl group, an alkoxy group or an acylamino group.

And in Formula [VIII], $R_7$ is as defined in the $R_7$ of Formula [VII], and $R_9$ is an amino group, a substituted amino group, a carbamido group, a sulfonamido group or a hydroxyl group.

Also, the n of Formula [VII] is an integer of 0 up to 2, and the m of Formula [VIII] is an integer of 0 or 1.

Further, the above groups each includes both one having no substituent and one having a substituent. Where the group has a substituent, the preferred substituent is one arbitrarily selected from the class consisting of halogen atoms and nitro, cyano, sulfonamido, hydroxyl, carboxyl, alkyl, alkoxy, carbonyloxy, acylamino and aryl groups.

The lipophilicity assumed by the $R_1$ through $R_9$ of the above Formulas may be selected arbitrarily according to purposes; in the case of general image-forming couplers, the total number of carbon atoms of each of the $R_1$ through $R_9$ is preferably from 10 to 60, and more preferably from 15 to 30.

On the other hand, in the case of a mobile dye-forming coupler, the dye formed by color development from which is to move moderately inside a light-sensitive material, the total number of carbon atoms of each of the $R_1$ through $R_9$ is preferred to be not more than 15.

Also, in the case of a substantially non-color-forming coupler, the total number of carbon atoms is preferred to be not more than 15, and further, each of the $R_1$ through $R_9$ is preferred to have at least one carboxyl, arylsulfonamido or alkylsulfonamido group as the substituent thereto.

The 'substantially non-color-forming coupler residue' herein implies one which, after its dye forming reaction, flows out of the light-sensitive material into the processing solution or one which reacts with the constituent of the processing solution to cause its once formed dye to be bleached, and as a result no dye image remains after development; the former is known as an effluent dye forming coupler and the latter as a bleachable dye forming coupler.

The color developing agent's oxidation product scavenger represented by the SC includes those of the oxidation-reduction type and those of the coupling type.

In Formula [I], the SC, representing a scavenger, is a group capable of reducing the oxidation product of a color developing agent in scavenging the oxidation product of the color developing agent through oxidation-reduction reaction. Preferred examples of the scavenger are those reducing agents as described in Angew. Chem. Int. Ed., 17 875–886 (1978). The Theory of the Photographic Process, 4th ed., (Macmillan 1977) Sec. 11, Japanese Patent Publication Open to Public Inspection (hereinafter referred to as Japanese Patent O.P.I. Publication) No. 5247/1984, or may be those precursors capable of releasing such reducing agents at the time of development. To be concrete, the preferred ones are compounds containing aryl or heterocyclic groups which, when reacting with the oxidation product of a color developing agent, have at least two groups selected from the class consisting of —OH group, $—NHSO_2$, group, $—NH_2$ group, —NHR group,

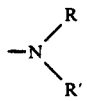

group, (wherein R and R' each is an alkyl, cycloalkyl, alkenyl or aryl group), and above all, the aryl group is preferred, and a phenyl group is more preferred. The lipophilicity of the SC, as has been mentioned in those couplers having the foregoing Formulas [II] through [VIII], may be discretionally selected according to purposes, but in order to have the effect of this invention exhibit to the utmost, where the DSR coupler is to be used in a color negative light-sensitive material in this invention, the total number of carbon atoms of the SC is preferably from 6 to 50, more preferably from 10 to 45, and most preferably from 15 to 45. Also, in this invention, where the DSR coupler is to be used in a color reversal light-sensitive material, the total number of carbon atoms of the SC is preferably from 6 to 30, and more preferably from 6 to 20.

Where the SC is to scavenge the oxidation product of a color developing agent in coupling reaction, the SC is a substantially non-color-forming coupler residue, and as the SC of this type, there may be utilized the foregoing effluent dye forming coupler, the foregoing bleachable dye forming coupler, and the white coupler which has in the reaction active site a nonsplit-off substituent to form no dye, and the like.

Examples of the compounds representative of the Coup-SC of Formula [I] are disclosed in, e.g., British Patent No. 1,546,837, and Japanese Patent O.P.I. Publication Nos. 150631/1977, 111536/1982, 111537/1982, 138636/1982, 53643/1986, 84646/1986, 86751/1986, 102646/1986, 102647/1986, 107245/1986 and 113060/1986.

An oxidation-reduction-type scavenger can be suitably used as the SC. Scavengers of this type are advantageous in respect that they are reusable by the reduction of the oxidation product of a color developing agent.

The following are examples of the above-mentioned DSR coupler, but the present invention is not limited to and by the following compounds. In addition, the general formula indicated above each of the following tables represents the general formula of compounds in combination of the SC with couplers having Formulas [II] through [VIII].

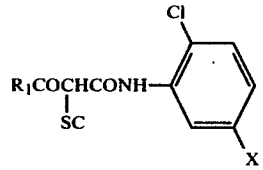
| Ex. cpd. No. | SC | $R_1$ | X |
|---|---|---|---|
| DSR-1 | 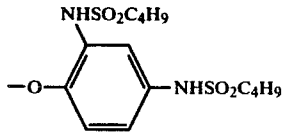 | 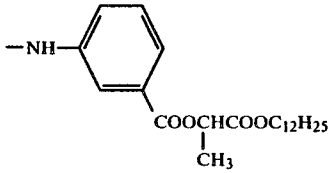 | $-COOCH(CH_3)COOC_{12}H_{25}$ |
| DSR-2 | 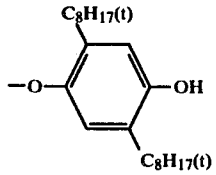 | $-C(CH_3)_3$ | 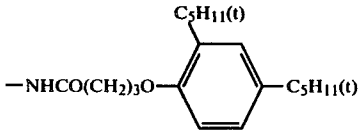 |
| DSR-3 | 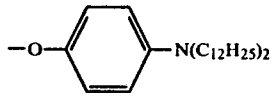 | $-C(CH_3)_3$ | $-COOCH(C_2H_5)COOC_{12}H_{25}$ |
| DSR-4 | 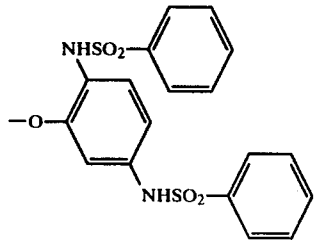 | $-C(CH_3)_3$ | $-NHSO_2C_{16}H_{33}$ |

-continued
| | | | |
|---|---|---|---|
| DSR-5 | 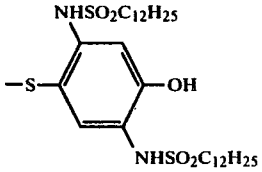 | 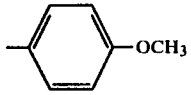 | $-COOH$ |
| DSR-6 | 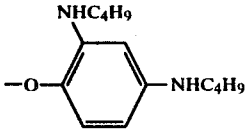 | $-C(CH_3)_3$ | $-NHCOCH(CH_3)SO_2C_{12}H_{25}$ |
| DSR-7 | 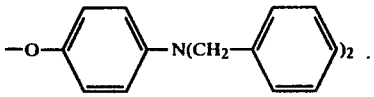 | 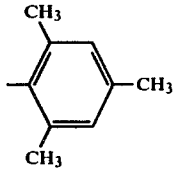 | 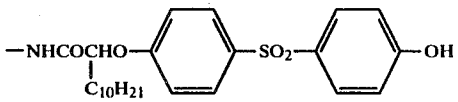 |
| DSR-8 | 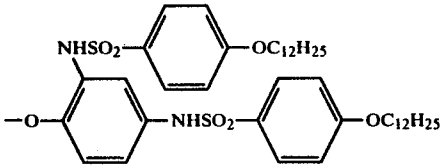 | $-C(CH_3)_3$ | 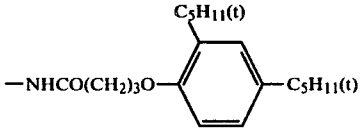 |
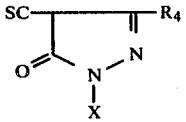
| Ex. cpd. No. | SC | $R_4$ | X |
|---|---|---|---|
| DSR-9 | 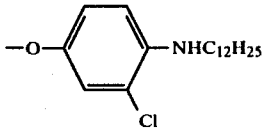 | 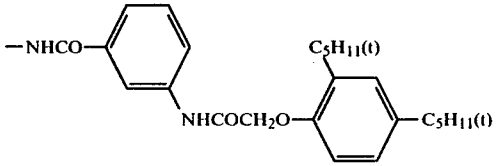 | 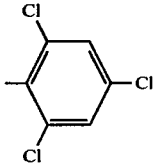 |

-continued
| | | | |
|---|---|---|---|
| DSR-10 | 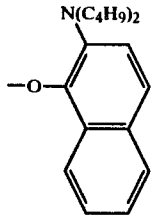 | 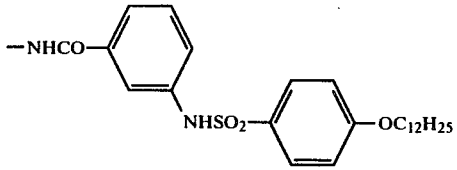 | 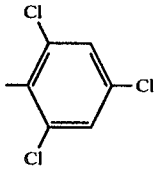 |
| DSR-11 | 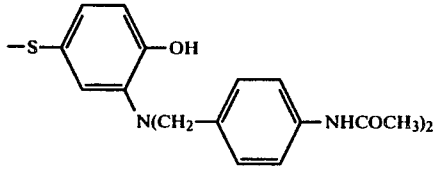 | 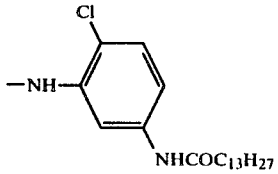 | 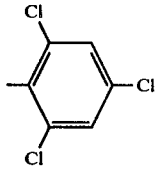 |
| DSR-12 | 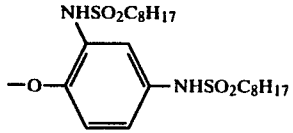 | 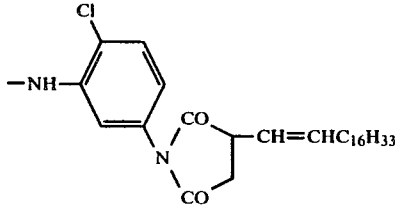 | 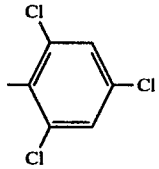 |
| DSR-13 | 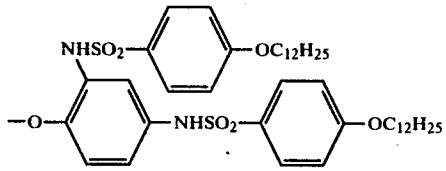 | $-NHCOC(CH_3)_3$ | 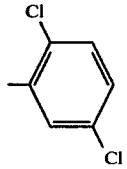 |
| DSR-14 | 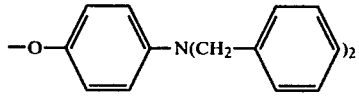 | $-NHCO(CH_2)_2COOH$ | 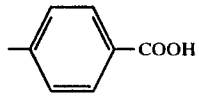 |

-continued
| | | | |
|---|---|---|---|
| DSR-15 | 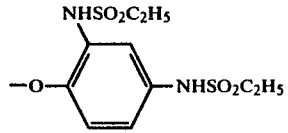 | 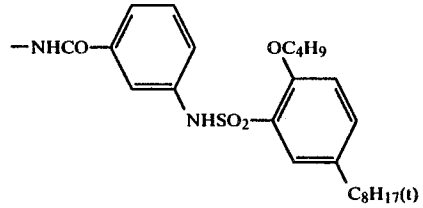 | 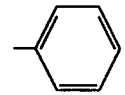 |

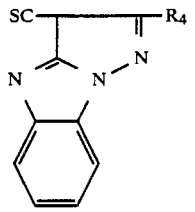
| Ex. cpd. No. | SC | $R_4$ |
|---|---|---|
| DSR-16 | 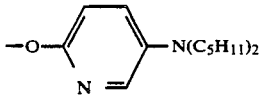 | 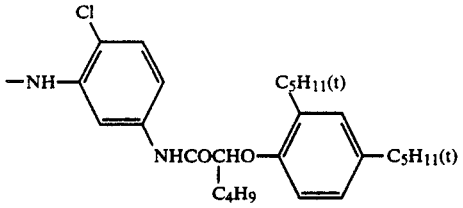 |
| DSR-17 | 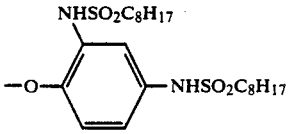 | 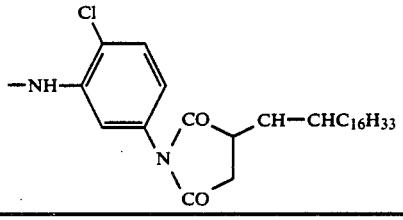 |

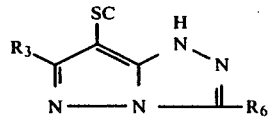
| Ex. cpd. No. | SC | $R_3$ | $R_6$ |
|---|---|---|---|
| DSR-18 | 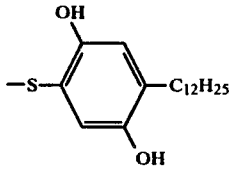 | $-CH_3$ | 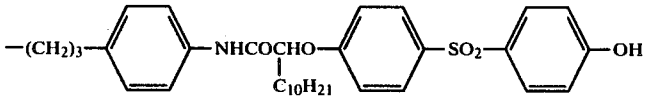 |
| DSR-19 | 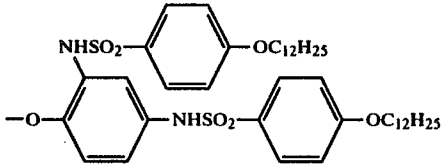 | $-CH_3$ | 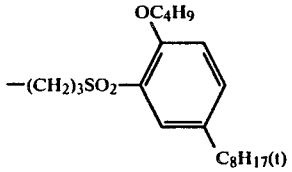 |

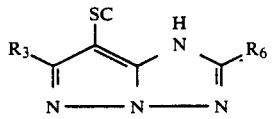
| Ex. cpd. No. | SC | $R_3$ | $R_6$ |
|---|---|---|---|
| DSR-20 | 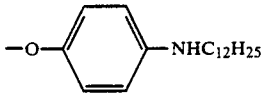 | $-CH_3$ | 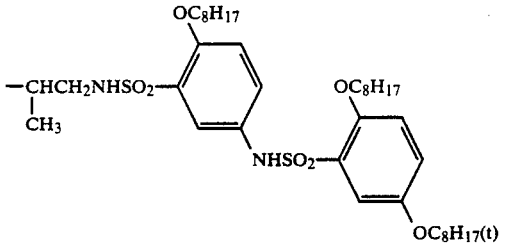 |
| DSR-21 | 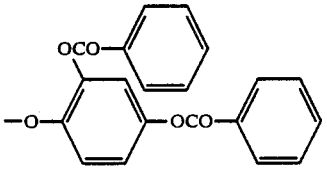 | $-CH_3$ | 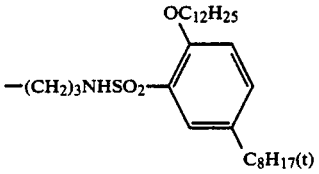 |

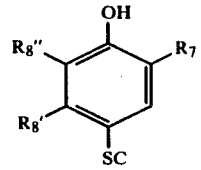
| Ex. cpd. No. | SC | $R_7$ | $R_8'$ | $R_8''$ |
|---|---|---|---|---|
| DSR-22 | 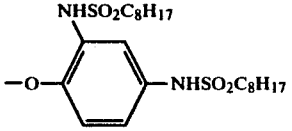 | 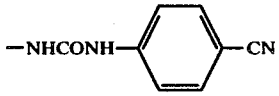 | 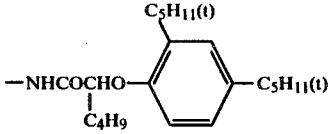 | —H |
| DSR-23 | 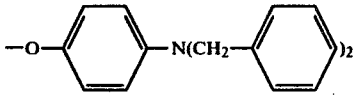 | 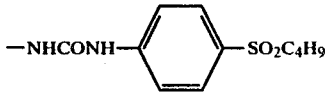 | 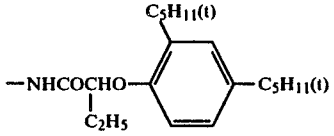 | —H |
| DSR-24 | 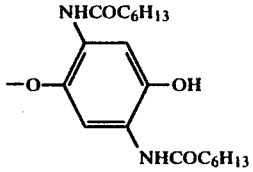 | 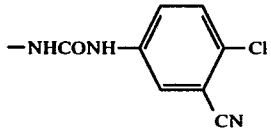 | 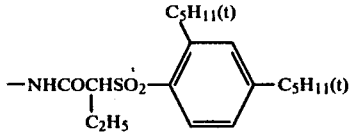 | —H |
| DSR-25 | 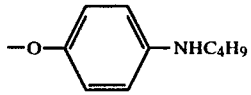 | 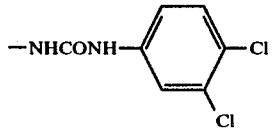 | 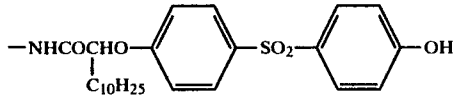 | —H |
| DSR-26 | 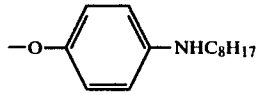 | 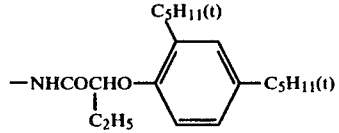 | $-C_2H_5$ | —Cl |

-continued
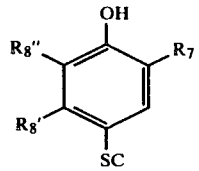
| Ex. cpd. No. | SC | $R_7$ | $R_8'$ | $R_8''$ |
|---|---|---|---|---|
| DSR-27 | 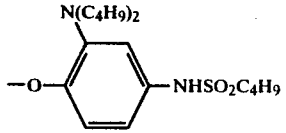 | 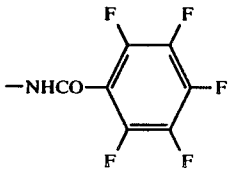 | 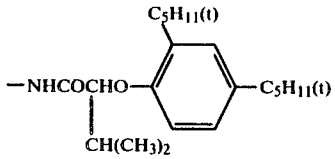 | —H |
| DSR-28 | 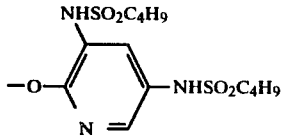 | —NHCOC$_3$H$_7$ | 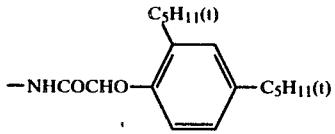 | —H |

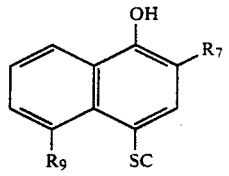
| Ex. cpd. No. | SC | $R_7$ | $R_9$ |
|---|---|---|---|
| DSR-29 | 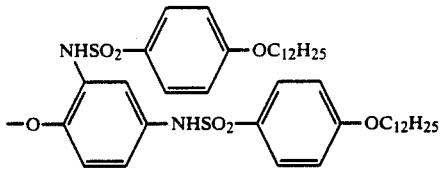 | 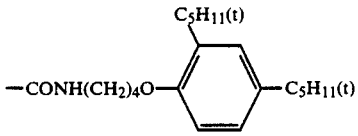 | —H |
| DSR-30 | 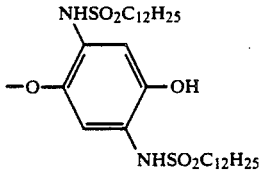 | 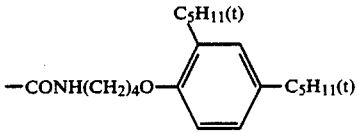 | —NHCOOC$_4$H$_9$(i) |
| DSR-31 | 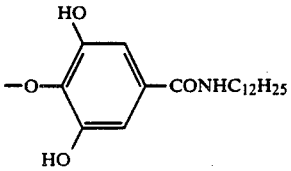 | 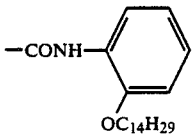 | —H |
| DSR-32 | 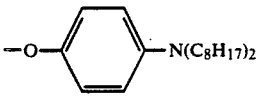 | 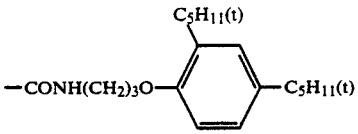 | —H |
| DSR-33 | 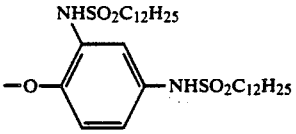 | —CONH(CH$_2$)$_2$COOH | —H |
| DSR-34 | 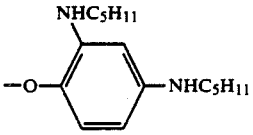 | 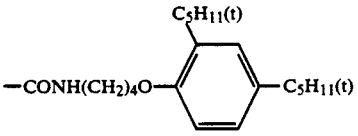 | —H |
| DSR-35 | 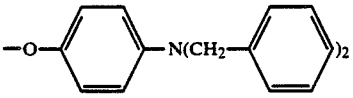 | —CONH(CH$_2$)$_3$OC$_{12}$H$_{25}$ | —NHCOOC$_4$H$_9$(i) |
| DSR-36 | 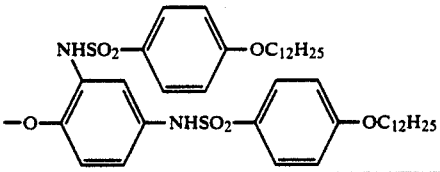 | —CONHC$_6$H$_{13}$ | —H |

DSR-37
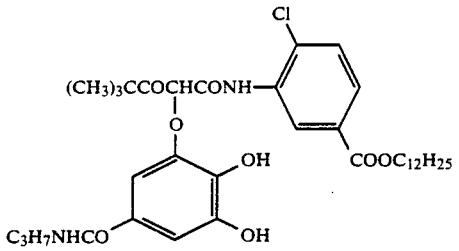
DSR-38
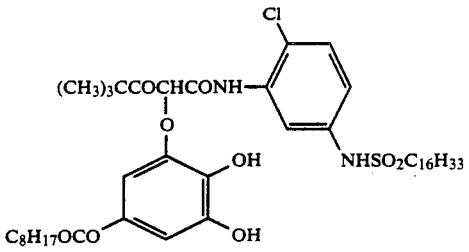
DSR-39
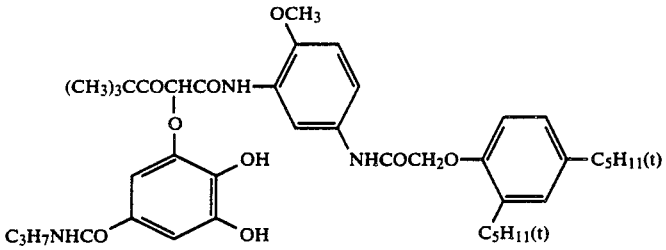
DSR-40
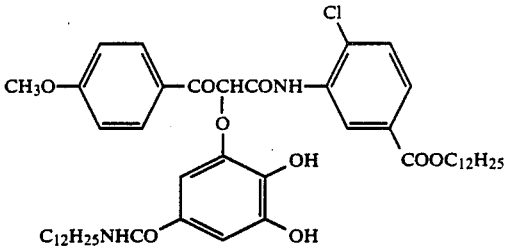
DSR-41
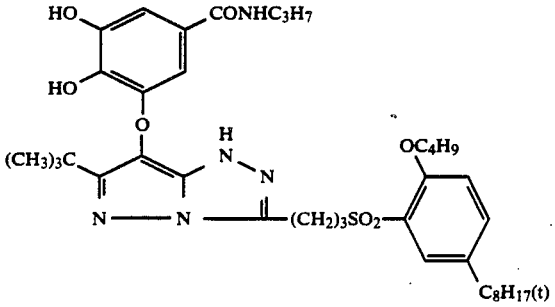
DSR-42
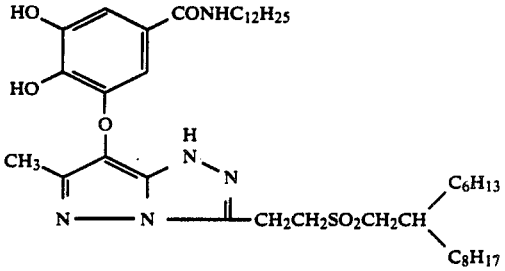

-continued
DSR-43
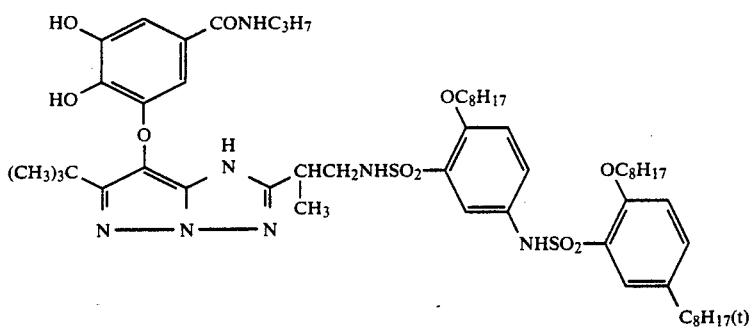
DSR-44
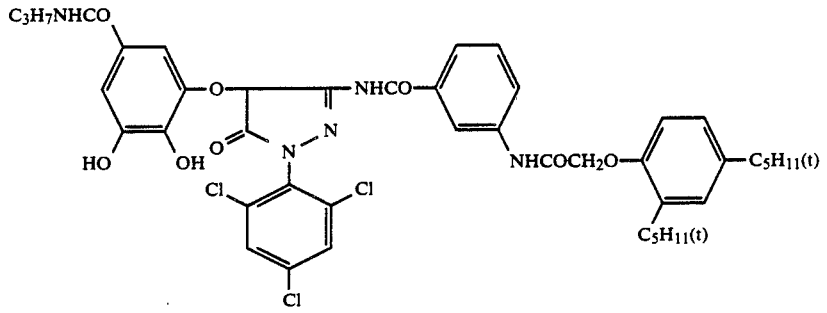
DSR-45
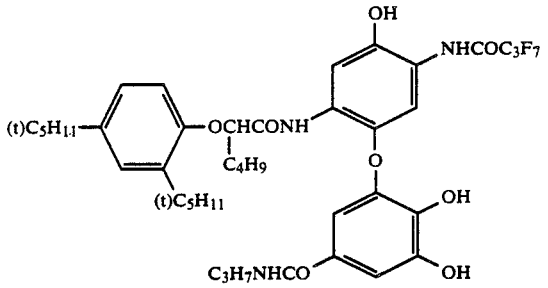
DSR-46
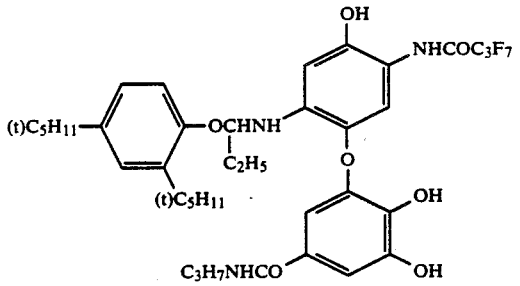
DSR-47
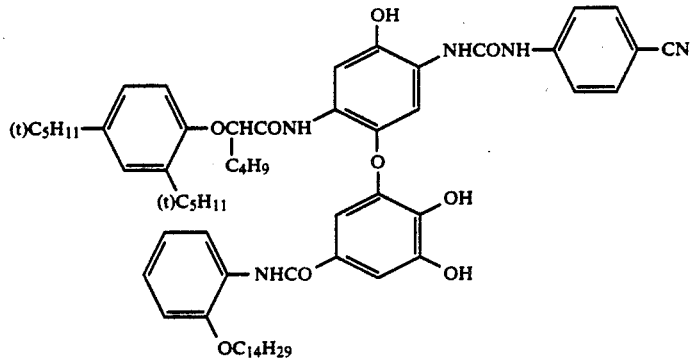

-continued

DSR-48

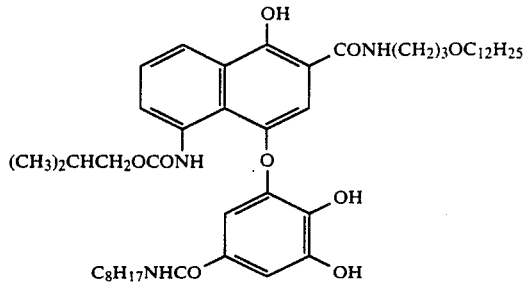

DSR-49

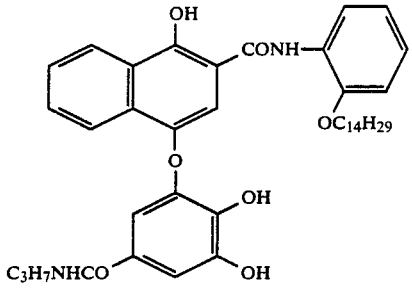

DSR-50

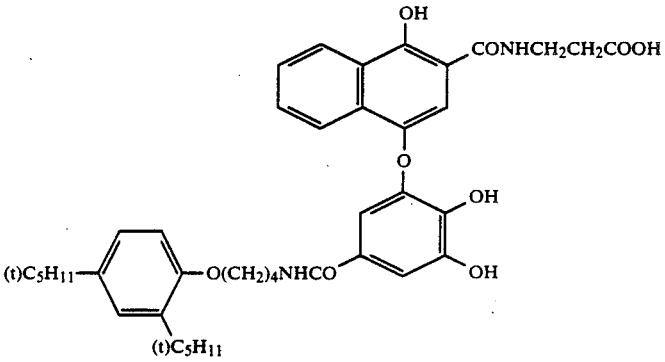

Any of the above DSR couplers may be incorporated into arbitrary layers of a photographic material, for example, silver halide emulsion layers and/or non-light-sensitive hydrophilic colloid layers. They should be used preferably in silver halide emulsion layers, and more preferably in a red-sensitive silver halide emulsion layer and/or a green-sensitive silver halide emulsion layer.

The incorporation of the DSR coupler of this invention into a hydrophilic colloid layer of a color light-sensitive material may be made in the manner that the DSR coupler is used single or used in combination of two or more kinds thereof to be dissolved into a mixture liquid of a high-boiling solvent such as, e.g., dibutyl phthalate, tricresyl phosphate, dinonyl phenol, or the like and a low-boiling solvent such as, e.g., butyl acetate, propionic acid, or the like, and after that, the solution is mixed with an aqueous gelatin solution containing a surface active agent, then the mixture is emulsifiedly dispersed by means of a high-speed rotary mixer, colloid mill or ultrasonic disperser, and then added directly to an emulsion, or the above dispersed liquid, which, after being set, is cut into small pieces and then washed, may be added to an emulsion.

In the case where the DSR coupler is contained in an emulsion layer, the using amount of the DSR coupler of this invention is preferably from 0.0005 to 5.0 moles per mole of the silver halide contained in the emulsion layer containing the DSR coupler, and more preferably from 0.005 to 1.0 mole.

The DSR coupler may be used alone or in combination of selected two or more kinds thereof.

The total dry thickness of the photographic component layers of the color light-sensitive material of this invention is not more than 18 μm. The dry layer thickness in this invention means the thickness measured under an atmospheric condition of 23° C./55% RH (RH stands for relative humidity). In order to measure the thickness of each individual layer, because the above photographic component layers are comprised of a plurality of layers, the image of the cross-section of a dry sample of the light-sensitive material is magnifiedly photographed by and through a scanning electron microscope, and then the measurement of the thicknesses of the respective layers is made on the enlarged photographic image. In this invention, the reason that the upper limit of the dry thickness is restricted to 18 μm is for the purpose of improving the sharpness, and if the thickness is equal to or less than 18 μm, a satisfactory sharpness can be obtained. On the other hand, the lower limit of the dry thickness, although not restrictive, is necessarily restricted by the volume occupied by the containing silver halide emulsion, oily agents such as couplers, etc., additives, binder such as gelatin, and the like, so that the lower limit is preferred to be settled to not less than 5 μm, and more preferably from 10 to 16

μm. Also, the thickness of the photographic component layers, from the topmost surface to the bottom of the emulsion layer located nearest to the support, is preferably not more than 15 μm, and the thickness from the topmost surface to the bottom of the emulsion layer which is different in the color sensitivity from the emulsion layer nearest to the support and which is the second nearest to the support is preferred to be not more than 10 μm.

The silver halide emulsion layers of this invention need only be comprised of at least one red-sensitive layer, at least one green-sensitive layer and at least one blue-sensitive layer on a support. These layers may be located in order from the support side of a red-sensitive layer, a green-sensitive layer and a blue-sensitive layer, but different other orders may also be used. However, the former order is preferred. The each individual layer is preferred to be comprised of a single layer or sub-layers, and more preferably two or more sub-layers.

And a non-light-sensitive hydrophilic colloid layer may be provided partly or all between these light-sensitive silver halide emulsion layers different in the color sensitivity and between these light-sensitive silver halide emulsion layers equal in the color sensitivity but different in the speed. Further, on the topmost layer may be provided a non-light-sensitive hydrophilic colloid layer as a protective layer.

The emulsion layers of the light-sensitive material of this invention contains dye-forming couplers which are to make coupling reactions with the oxidation product of an aromatic primary amine developing agent (such as, e.g., a p-phenylenediamine derivative, an aminophenol derivative, etc.) in the color developing process to thereby form dyes. These dye-forming couplers are usually selected so as to form dyes that absorb the appropriate spectral lights to which the respective emulsion layers are sensitive, and an yellow dye-forming coupler is used for the blue-sensitive emulsion layer, a magenta dye-forming coupler for the green-sensitive emulsion layer, and a cyan dye-forming coupler for the red-sensitive emulsion layer.

In practicing this invention, as the yellow coupler, benzoyl-type couplers may be suitably used, and particularly, those yellow couplers having the following Formula [Y-1] are preferred.

Formula [Y-I]

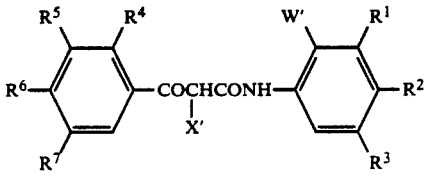

in $R^1$, $R^2$ and $R^3$ may be either the same or different and each is a hydrogen atom, a halogen atom (such as fluorine, Chlorine, bromine or the like), an alkyl group (such as methyl, ethyl, allyl, dodecyl or the like), an aryl group (such as phenyl, naphthyl or the like), an alkoxy group (such as methoxy, ethoxy, dodecyloxy, or the like), an acylamino group (such as acetamido, α-(p-dodecyloxyphenoxy)butaneamido or the like), a carbamoyl group (such as carbamoyl, N,N-dimethylcarbamoyl, N-δ-(2,4-di-tert-amylphenoxy)butylcarbamoyl or the like), an alkoxycarbonyl group (such as ethoxycarbonyl, dodecyloxycarbonyl, α-(dodecyloxycarbonyl)ethoxycarbonyl or the like), a sulfonamido group (such as methanesulfonamido, p-dodecyloxybenzenesulfonamido, N-benzyldodecanesulfonamido or the like), or a sulfamoyl group (such as sulfamoyl, N-methylsulfamoyl, N-δ-(2,4-di-tert-amylphenoxy)butylsulfamoyl, N,N-diethylsulfamoyl or the like);

$R^4$, $R^5$ $R^6$ and $R^7$ may be either the same or different and each is a hydrogen atom, an alkyl group (such as methyl, ethyl, tert-butyl or the like), an alkoxy group (such as methoxy, ethoxy, propoxy, octoxy or the like), an aryloxy group (such as phenoxymethylphenoxy), an acylamino group (such as acetamido, α-(Z,4-di-tert-amylphenoxy)butaneamido or the like) or asulfonamido group (such as methanesulfonamido, p-dodecylbenzenesulfonamido, N-benzyldodecanesulfonamido or the like);

W' is a halogen atom (such as fluorine, chlorine, bromine or the like), an alkyl group (such as methyl, ethyl, tert-butyl or the like), an alkoxy group (such as methoxy, ethoxy, propoxy, octoxy or the like), an aryloxy group (such as phenoxy, methylphenoxy or the like) or a dialkylamino group (such as dimethylamino. N-butyl-N-octylamino or the like), and;

X' is a hydrogen atom or a splittable group: The preferred group as the splittable group is one having the following Formula [Y-II]:

Formula [Y-I ]

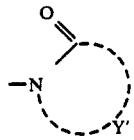

wherein Y' is a group of nonmetallic atoms necessary to form a 5- or 6-member ring. Examples of the cyclic compound include derivatives such as, e.g., 2,5-dioxyimidazoline, 2,5-pyrrolidinedione, 1,3-isoindoledione, 2,3,5-trioxo-imidazolidine, 2,5-dioxo-triazolidine,2,4-oxazolidinedione, 2,4-thiazolidinedione, 2(1H)-pyridine, 2(1H)-pyrimidone, 2(1H)-pyrazone, 5(1H)-imidazolone, 5(1H)-triazolone, 2(1H)-pyrimidone, 2-pyrazone (5), 2-isothiazolone, 2(1H)-quinaoxazolone, 4(3H)-pyrimidone, 2-benzoxazolone, 4-isooxazolone(5), 3-fluorone(2), 4-imidazolone(2), 3-pyrazolone, 2-tetrazolone(5), 3-tetrazolone(5), and the like.

The following are examples of the compounds as the yellow coupler having Formula [Y-I]:

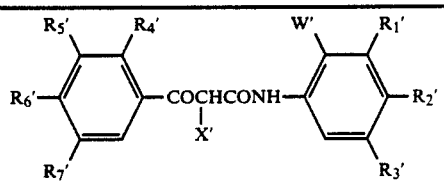

| Ex. cpd. No. | $R_1'$ | $R_2'$ | $R_3'$ | $R_4'$ | $R_5'$ | $R_6'$ | $R_7'$ | .W' | X' |
|---|---|---|---|---|---|---|---|---|---|
| Y-1 | —H | —H | (7) | —H | —H | (4) | —H | (1) | (16) |
| Y-2 | —H | —H | (7) | —H | —H | (4) | —H | (1) | (17) |
| Y-3 | —H | —H | (8) | —H | —H | —H | —H | (1) | (18) |
| Y-4 | —H | —H | (8) | —H | —H | —H | —H | (4) | (19) |
| Y-5 | —H | —H | (6) | (2) | —H | —H | —H | (4) | (20) |
| Y-6 | —H | —H | (9) | —H | —H | (4) | —H | (1) | (21) |
| Y-7 | —H | —H | (11) | —H | (10) | (4) | —H | (4) | (22) |
| Y-8 | —H | —H | —H | —H | —H | —H | (7) | (4) | (23) |
| Y-9 | —H | —H | (12) | —H | —H | (4) | —H | (1) | (24) |
| Y-10 | —H | —H | (13) | —H | —H | —H | —H | (1) | (25) |
| Y-11 | —H | —H | (14) | —H | —H | (4) | —H | (1) | (26) |

-continued
| | | | | | | | | | |
|---|---|---|---|---|---|---|---|---|---|
| Y-12 | —H | —H | (15) | —H | —H | (4) | —H | (4) | (27) |
| Y-13 | —H | —H | —H | —H | —H | (4) | —H | (4) | —H |
| Y-14 | —H | —H | —H | —H | —H | (5) | —H | (1) | (28) |
| Y-15 | —H | —H | (6) | —H | —H | (4) | —H | (1) | (29) |
(1) —Cl,
(2) —$CH_3$,
(3) —$C_{18}H_{37}$,
(4) —$OCH_3$,
(5) —$NHCOC_{17}H_{35}$,
(6) —$COOC_{12}H_{25}$,
(7)
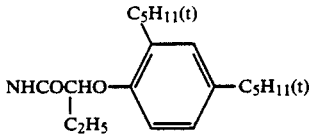
(8) —$COOCH(CH_3)COOC_{12}H_{25}$
(9) —$NHCOCH(CH_3)CH_2SO_2C_{12}H_{25}$
(10)
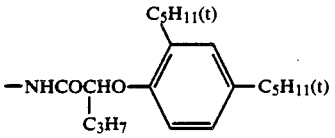
(11)
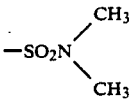
(12)
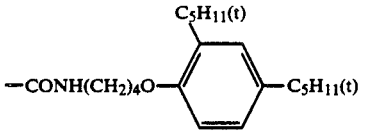
(13) —$COOCH(CH_3)CH_2SO_2C_{12}H_{25}$
(14)
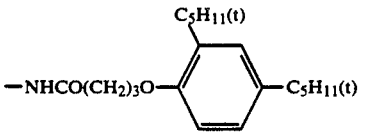
(15)
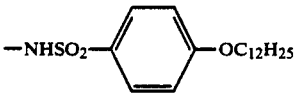
(16)
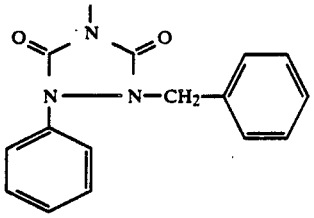
-continued
(17)
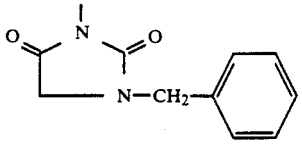
(18)
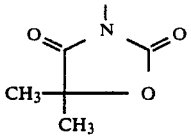
(19)
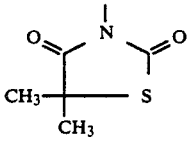
(20)
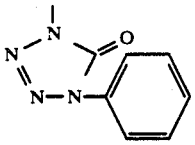
(21)
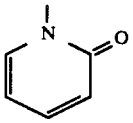
(22)
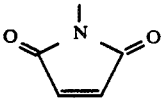
(23)
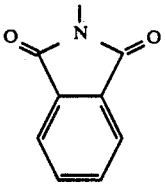
(24)
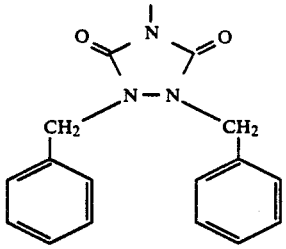
(25)
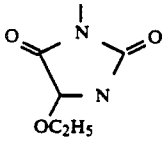

-continued (26)

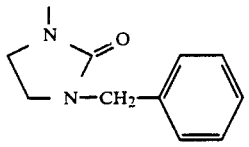

(27)

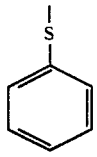

(28)

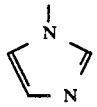

(29)

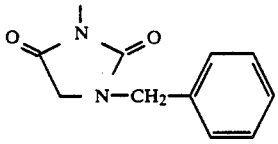

The magenta dye image-forming couplers suitably usable in this invention are those pyrazolotriazole-type magenta couplers represented by the following Formulas [M-I] and [M-II]:

Formula [M-I]

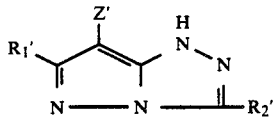

. Formula [M-II]

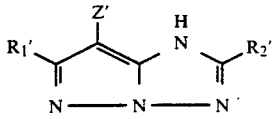

In Formulas [M-I] and [M-II], $R_1'$ and $R_2'$ each is an alkyl group, a cycloalkyl group, n aryl group or a heterocyclic group, provided that the alkyl group, cycloalkyl group, aryl group and heterocyclic group each may be linked through an oxygen atom, a nitrogen atom or a sulfur atom. Further, the above alkyl group, cycloalkyl group, aryl group and heterocyclic group each may be linked through a linkage group such as an acylamino, carbamoyl, sulfonamido, sulfamoylcarbonyl, carbonyloxy, oxycarbonyl, ureido, thioureido, thioamido, sulfo or sulfonyloxy group.

The alkyl group represented by the $R_1'$) and $R_2'$ is preferably a straight-chain or branched-chain alkyl group having from 1 to 20 carbon atoms. The alkyl group includes those further having a substituent (such as a halogen atom or a nitro, cyano, alkoxy, aryloxy, amino, acylamino, carbamoyl, sulfonamido, sulfamoyl, imido, alkylthio, arylthio, aryl, alkoxycarbonyl or acyl group).

The cycloalkyl group includes, e.g., cyclopropyl group, cyclohexyl group, and the like, and also includes those having a substituent as defined in the above alkyl group.

The aryl group includes, e.g., phenyl and naphthyl groups and also includes those having a substituent as defined in the above alkyl group.

The above heterocyclic group is a 5- or 6-member ring having at least any one of nitrogen, oxygen and sulfur atoms, and may be either aromatic or nonaromatic, and is, for example, a pyridyl, quinolyl, pyrrolyl, morpholyl, furanyl, tetrahydrofuranyl, pyrazolyl, triazolyl, tetrazolyl, thiazolyl, oxazolyl, imidazolyl, thiadiazolyl or the like group. These groups also include those having a substituent as defined in the foregoing alkyl group.

The following are examples of the magenta dye image-forming couplers suitably usable in this invention.

M-1

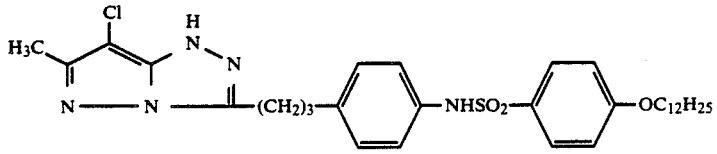

M-2

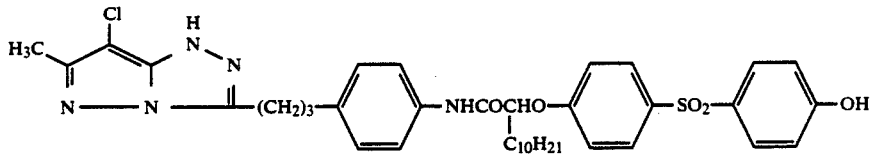

M-3

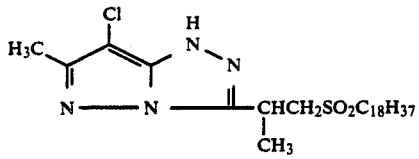

-continued
M-4
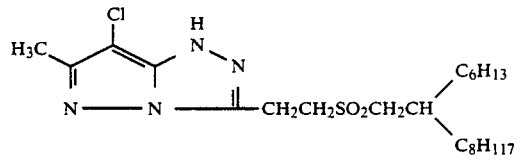
M-5
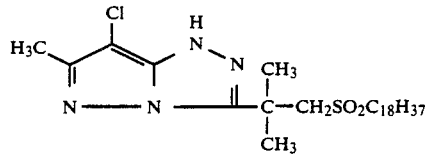
M-6
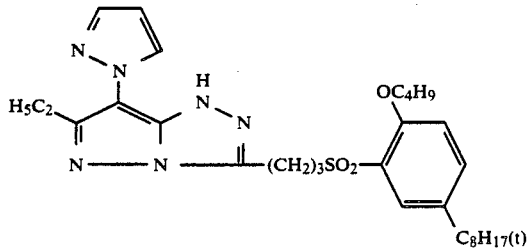
M-7
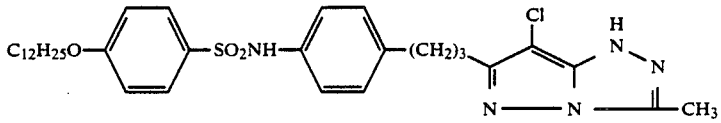
M-8
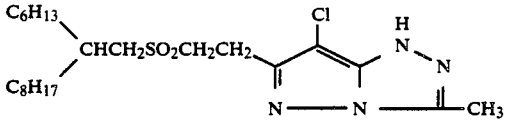
M-9
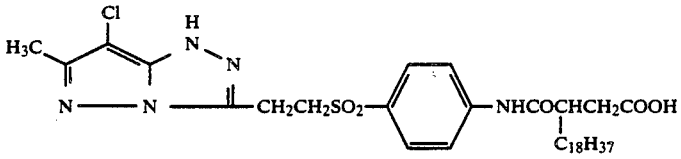
M-10
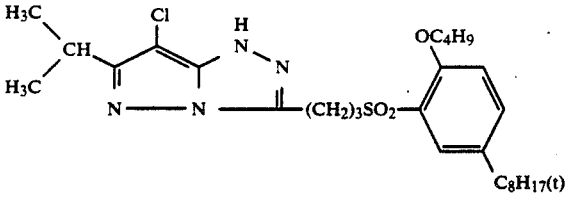
M-11
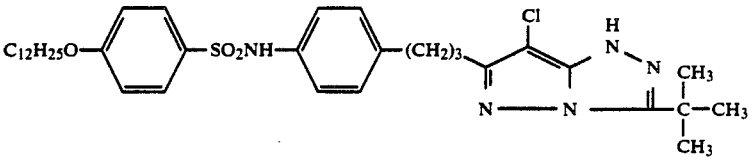

-continued

M-12

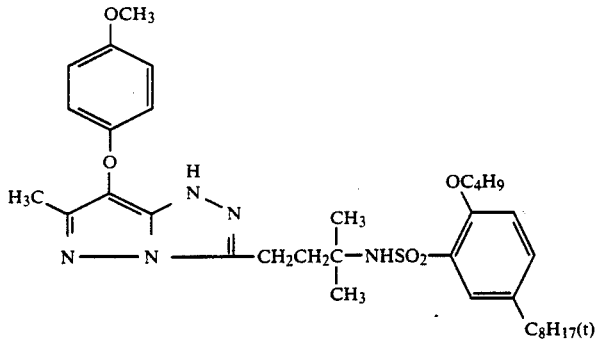

M-13

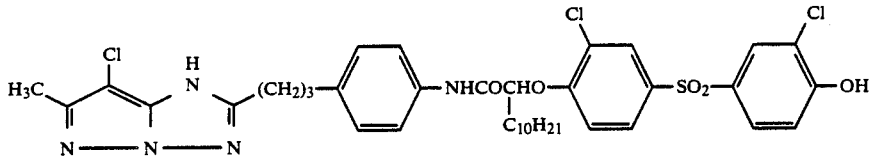

M-14

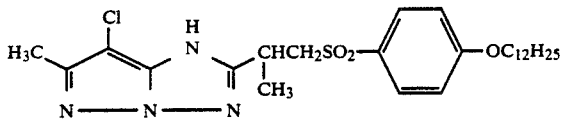

M-15

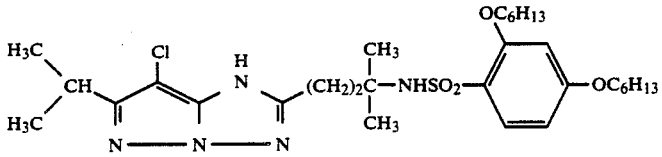

M-16

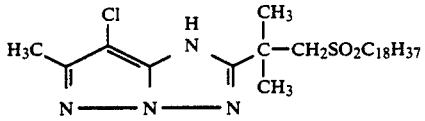

M-17

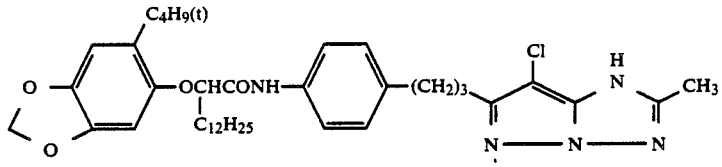

M-18

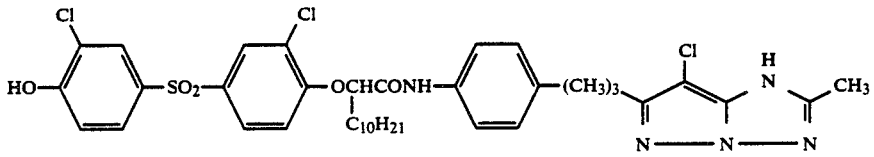

M-19

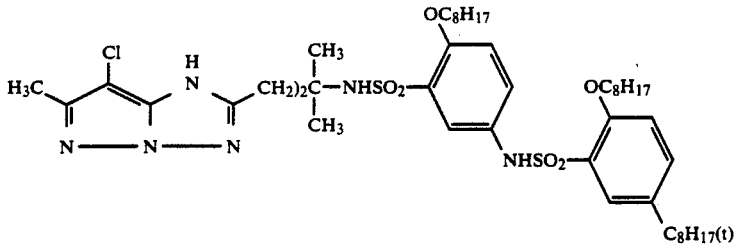

As a cyan dye image forming coupler, any well-known cyan dye-forming coupler, such as of the phenol type or naphthol type or unreido-substituted one of these, may be used.

In practicing this invention, a diffusible DIR compound may be suitably used. The diffusible DIR compound will be explained below:

The diffusible DIR compound is a compound which is capable of releasing a development inhibitor or a compound to turn into a development inhibitor that can be split off as a result of its reaction with the oxidation product of a color developing agent, the diffusibility of which development inhibitor or compound to turn into a development inhibitor is not less than 0.40 in accordance with the evaluation method that will be described below:

The diffusibility is to be evaluated in accordance with the following method:

Light-sensitive material samples (I) and (II) comprising a transparent support having thereon the following composition-having layers are prepared.

Sample (I)

A green-sensitive silver halide emulsion layer-having sample:

A gelatin coating liquid containing silver iodobromide (containing 6 mole % silver iodide, average grain size: 0.48 μm) spectrally sensitized to be green-sensitive and 0.07 mole per mole of silver of the following coupler is coated so that the coated amount of silver is 1.1 g/m$^2$ and the coated amount of gelatin is 3.0 g/m$^2$, and on the emulsion layer is then coated, as a protective layer, gelatin liquid containing silver iodobromide not chemically sensitized nor spectrally sensitized (containing 2 mole % silver iodide, average grain size: 0.08 μm) so that the coated amount of silver is 0.1 g/m$^2$ and the coated amount of gelatin is 0.8 g/m$^2$.

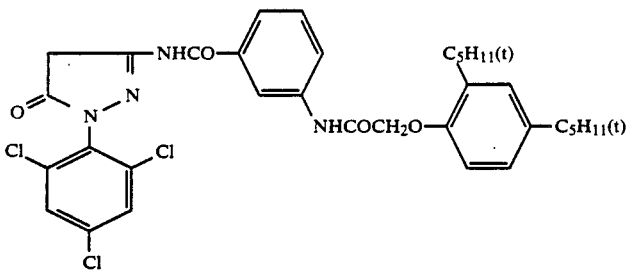

Sample (II)

A green-sensitive silver halide emulsion layer-having sample which is the same as Sample (I) except that the silver iodide is removed from the protective layer of Sample (I)

Each of the above layers contains additives such as a gelatin hardener and a surface active agent in addition to th above.

Samples (I) and (II) each is exposed through an wedge to white light, and then processed in accordance with the following processing method. In the processing, two different developer solutions are used: one-developer solution to which is added each of various development restrainers in an amount to restrain the sensitivity of Sample (II) down to 60% (−Δlog E=0.22), and the other to which is added no development restrainer.

| Processing Steps (at 38° C.) | |
|---|---|
| Color developing | 2 min. and 40 sec. |
| Bleaching | 6 min. and 30 sec. |

-continued

| Processing Steps (at 38° C.) | |
|---|---|
| Washing | 3 min. and 15 sec. |
| Fixing | 6 min. and 30 sec. |
| Washing | 3 min. and 15 sec. |
| Stabilizing | 1 min. and 30 sec. |
| Drying | |

The composition of the processing solutions to be used in the respective steps are as follows:

| | |
|---|---|
| <Color Developer Solution> | |
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter. | |
| <Bleaching Bath> | |
| Iron-ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Water to make 1 liter. Use aqueous ammonia to adjust the pH to 6.0. | |
| <Fixer Bath> | |
| Ammonium thiosulfate | 175.0 g |
| Anhydrous sodium sulfite | 8.5 g |
| Sodium metasulfite | 2.3 g |
| Water to make 1 liter. Use acetic acid to adjust the pH to 6.0. | |
| <Stabilizer Bath> | |
| Formalin (37% aqueous solution) | 1.5 ml |
| Koniducks (product of Konishiroku Photo Ind. Co., Ltd.) | 7.5 ml |
| Water to make 1 liter | |

If the sensitivities of Sample (I) and Sample (II) when processed in the developer without adding any development restrainer thereto are regarded as $S_o$ and $S_o'$, respectively, and if the sensitivities of Sample (I) and Sample (II) when processed in the developer with a development restrainer added thereto are regarded as $S_I$ and $S_{II}$, respectively, then the degree of desensitization of Sample (I) is expressed as $\Delta S = S_o - S_I$, the degree of desensitization of Sample (II) as $\Delta S_o = S_o' - S_{II}$, and the diffusibility as $\Delta S/\Delta S_o$, provided that the sensitivity is all expressed in terms of the logarithm of reciprocal of the exposure (−log E) at the density point of fog +0.3.

The diffusibilities of several kinds of the development restrainer that are found according to this method will be exemplifed in the following table.

TABLE
| Structure | Adding amt (Mol/liter) | Desensitized degree $\Delta S_0$ | Desensitized degree $\Delta S$ | Diffusibility $\Delta S/\Delta S_0$ |
|---|---|---|---|---|
| 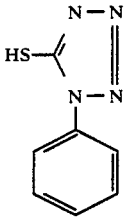 | $1.3 \times 10^{-5}$ | 0.22 | 0.05 | 0.23 |
| 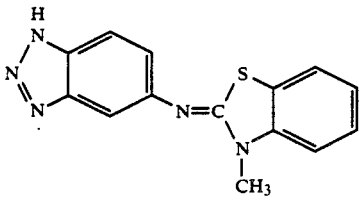 | $1.3 \times 10^{-5}$ | 0.23 | 0.08 | 0.34 |
| 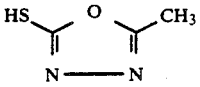 | $2.5 \times 10^{-5}$ | 0.22 | 0.10 | 0.45 |
| 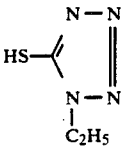 | $3.0 \times 10^{-5}$ | 0.21 | 0.10 | 0.48 |
| 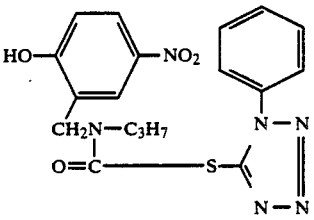 | $1.4 \times 10^{-5}$ | 0.23 | 0.11 | 0.48 |
| 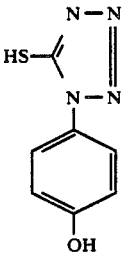 | $2.5 \times 10^{-5}$ | 0.22 | 0.13 | 0.59 |
| 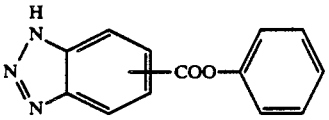 | $3.5 \times 10^{-5}$ | 0.23 | 0.15 | 0.65 |
| 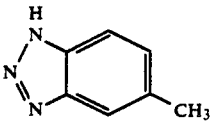 | $4.3 \times 10^{-5}$ | 0.22 | 0.16 | 0.73 |

TABLE-continued

| Structure | Adding amt (Mol/liter) | Desensitized degree $\Delta S_0$ | Desensitized degree $\Delta S$ | Diffusibility $\Delta S/\Delta S_0$ |
|---|---|---|---|---|
| 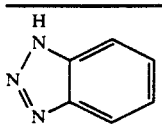 | $1.7 \times 10^{-4}$ | 0.21 | 0.20 | 0.95 |

As the diffusible DIR compound suitably usable in this invention, as long as the diffusibility of the group released therefrom falls under the above range, any DIR compound may be used regardless of its chemical structure.

A structural formula representative of the diffusible DIR compound will be given below:

Formula (D-I)

A—(Y)m wherein A is a coupler residue, m is an integer of 1 or 2, and Y is a group which is combined with the coupler residue A at the coupling position thereof and splits off as a result of the reaction with the oxidation product of a color developing agent, and which is capable of releasing a development inhibitor group or development inhibitor whose diffusibility is not less than 0.40.

In Formula (D-1), the Y is typically represented by the following Formulas (D-2) through (D-9).

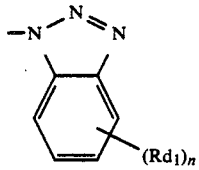

Formula (D-2)

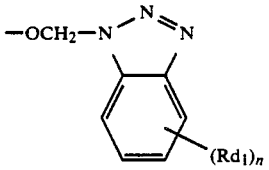

Formula (D-3)

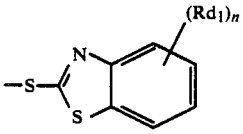

Formula (D-4)

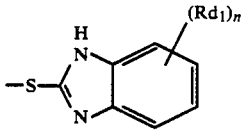

Formula (D-5)

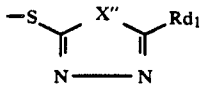

Formula (D-6)

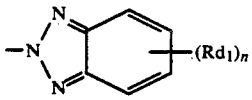

Formula (D-7)

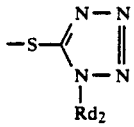

Formula (D-8)

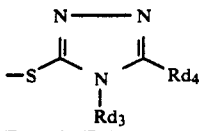

Formula (D-9)

In Formulas (D-2) through (D-7), $Rd_1$ is a hydrogen atom, a halogen atom, or an alkyl, alkoxy, acylamino, alkoxycarbonyl, thiazolylideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, heterocyclic, cyano, alkylsulfonyl or aryloxycarbonylamino group, and n is an integer of 0, 1 or 2, provided that when n is equal to 2, the two $R_1$s may be either the same or different, and the total number of carbon atoms contained in the n number of $Rd_1$s is from 0 up to 10, and also the number of carbon atoms contained in the $Rd_1$ of Formula (D-6) is from 0 up to 15.

In Formula (D-6), X" is an oxygen atom or a sulfur atom.

In Formula (D-8), $Rd_2$ is an alkyl, aryl or heterocyclic group.

In Formula (D-9), $Rd_1$ is a hydrogen atom or an alkyl, cycloalkyl, aryl or heterocyclic group, and $Rd_4$ is a hydrogen atom, a halogen atom or an alkyl, cycloalkyl, aryl, acylamino, alkoxycarbonylamino, aryloxycarbonylamino, alkanesulfonamido, cyano, heterocyclic, alkylthio or amino group.

When the $Rd_1$, $Rd_2$, $Rd_3$ or $Rd_4$ represents an alkyl group, the alkyl group includes those having a substituent and may be either straight-chain or branched-chain.

When the $Rd_1$, $Rd_2$, $Rd_3$ or $Rd_4$ represents an aryl group, the aryl group includes those having a substituent.

When the $Rd_1$, $Rd_2$, $Rd_3$ or $Rd_4$ represents a heterocyclic group, the heterocyclic group includes those having a substituent, and is preferred to be a 5- or 6-member single ring or condensed ring containing at least one hetero atom selected from the group consisting of nitrogen, oxygen and sulfur atoms, and the heterocyclic group is one selected from among, for example, pyridyl, quinolyl, furyl, benzothiazolyl, oxazolyl, imidazolyl, thiazolyl, triazolyl, benzotriazolyl, imido, oxazino, and the like group.

In Formulas (D-6) and (D-8), the number of carbon atoms contained in $Rd_2$ is from 0 up to 15.

In Formula (D-9), the total number of carbon atoms contained in $Rd_2$ and $R_4$ is from 0 up to 15.

Formula (D-10)

-TIME-INHIBIT wherein the TIME group is combined with the A at the coupling position thereof and is a group which is cleavable by the reaction with the oxidation product of a color developing agent and which, after being cleaved from the coupler, is releasable with controlling moderately the INHIBIT group; and the INHIBIT group is a group to turn into a development inhibitor (e.g., the group represented by (D-2) to (D-9)) by the above releasing.

The -TIME-INHIBIT group of Formula (D-10) is typically represented by the following Formulas (D-11) through (D-19).

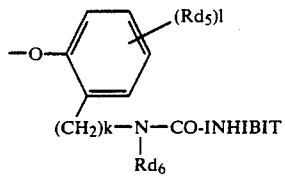

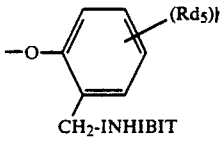

Formula (D-12)

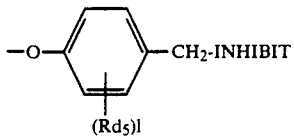

Formula (D-13)

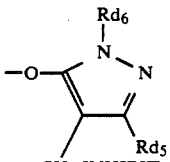

Formula (D-14)

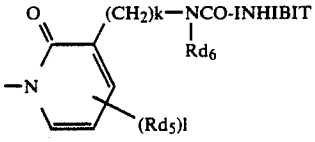

Formula (D-15)

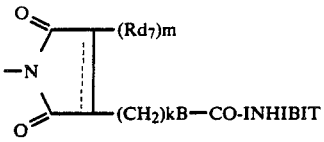

Formula (D-16)

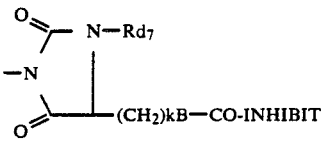

Formula (D-17)

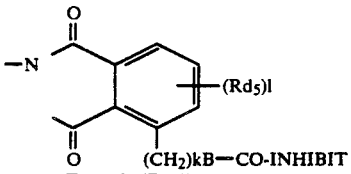

Formula (D-18)

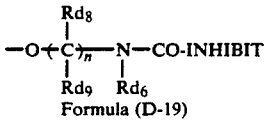

Formula (D-19)

In Formulas (D-11) through (D-15) and (D-18), $Rd_5$ is a hydrogen atom, a halogen atom or an alkyl, cycloalkyl, alkenyl, aralkyl, alkoxy, alkoxycarbonyl, anilino, acylamino, ureido, cyano, nitro, sulfonamido, sulfamoyl, carbamoyl, aryl, carboxy, sulfo, hydroxy, or alkanesulfonyl group. In Formulas (Dd-11) through (D-13), (D-15) and (D-18), the $Rd_5$s may combine with one another to form a condensed ring, and in Formulas (D-11), (D-14), (D-15) and (D-19), the $Rd_5$ represents an alkyl, alkenyl, aralkyl, cycloalkyl, heterocyclic or aryl group. In Formulas (D-16) and (D-17), $Rd_7$ is a hydrogen atom or an alkyl, alkenyl, aralkyl, cycloalkyl, heterocyclic or aryl group, and in Formula (D-19), $Rd_5$ and $Rd_9$ each is a hydrogen atom or an alkyl group (preferably an alkyl group having from 1 to 4 carbon atoms). In Formulas (D-11) and (D-15) through (D-18), k is an integer of 0, 1 or 2, and in Formulas (D-11) through (D-13), (D-15) and (D-18), 1 is an integer of from 1 to 4. In Formula (D-16), m is an integer of 1 or 2, provided that when m is 2, the $Rd_1$s may be either the same or different. In Formula (D-19), n is an integer of from 2 to 4, provided that the n number of $Rd_8$s and $Rd_9$s may be either the same or different, respectively. In Formulas (D-16) through (D-18), B is a hydrogen atom or a

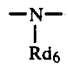

group (wherein $Rd_4$ is as defined previously). In Formula (D-16), the --- represents being allowed to be either a single bond or double bond, provided that when it is a single bond, the m is equal to 2, while when it is a double bond, the m is 1, and the INHIBIT group is the same as defined in Formulas (D-2) through (D-9) except the number of carbon atoms.

In the INHIBIT group, the total number of carbon atoms contained in the $R_1$ of one molecule in Formulas (D-2) through (D-7) is from 0 to 32, and the number of carbon atoms contained in the $Rd_2$ of Formula (D-8) is from 1 to 32, and the total number of carbon atoms contained in the $Rd_3$ and $Rd_4$ of Formula (D-9) is from 0 to 32.

When the $Rd_5$, $Rd_6$ or $Rd_7$ represents an alkyl, aryl or cycloalkyl group, they include those having a substituent.

The preferred among the diffusible DIR compounds are those represented by Formulas (D-2), (D-3) or (D-10), and the preferred among those of Formula (D-10) are those in which the INHIBIT group is represented by Formulas (D-2), (D-6) (particularly when the X of Formula (D-6) is an oxygen atom) or Formula (D-8) (particularly when the $Rd_2$ of Formula (D-8) is a hydroxyaryl group or an alkyl group having from 1 to 3 carbon atoms).

The coupler constituent represented by the A of Formula (D-1) is an yellow dye image-forming coupler residue, a magenta dye-image forming coupler residue, a cyan dye image-forming coupler residue or a colorless coupler residue.

The following are preferred examples of the diffusible DIR compound usable in practicing this invention, but the invention is not limited thereto.

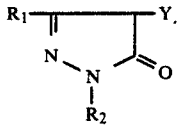

| Exemplified compound No. | $R_1$ | $R_2$ | Y |
|---|---|---|---|
| D'-9 | (9) | (10) | (30) |
| D'-10 | (11) | (10) | (30) |
| D'-11 | (12) | (7) | (34) |
| D'-12 | (12) | (13) | (35) |
| D'-13 | (9) | (14) | (36) |
| D'-14 | (15) | (16) | (37) |

Exemplified Compounds:

-continued
D'-1
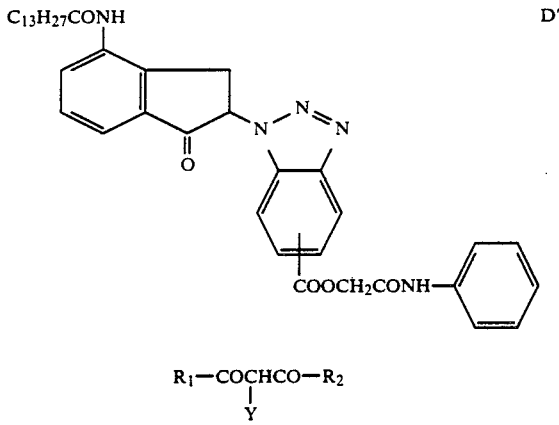
| Exemplified compound No. | $R_1$ | $R_2$ | Y |
|---|---|---|---|
| D'-2 | (1) | (1) | (30) |
| D'-3 | (2) | (3) | (30) |
| D'-4 | (2) | (4) | (30) |
| D'-5 | (5) | (6) | (31) |
| D'-6 | (2) | (4) | (32) |
| D'-7 | (2) | (3) | (32) |
| D'-8 | (7) | (8) | (33) |
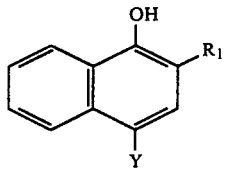
| Exemplified compound No. | $R_1$ | Y |
|---|---|---|
| D'-15 | (17) | (38) |
| D'-16 | (17) | (39) |
| D'-17 | (18) | (40) |
| D'-18 | (20) | (41) |
| D'-19 | (18) | (42) |
| D'-20 | (18) | (43) |
| D'-21 | (18) | (44) |
| D'-22 | (18) | (45) |
| D'-23 | (19) | (46) |
| D'-24 | (21) | (47) |
| D'-25 | (21) | (48) |
| D'-26 | (22) | (49) |
| D'-27 | (22) | (50) |
| D'-28 | (22) | (51) |
| D'-29 | (23) | (52) |
| D'-30 | (18) | (53) |
| D'-31 | (18) | (54) |
| D'-32 | (23) | (49) |
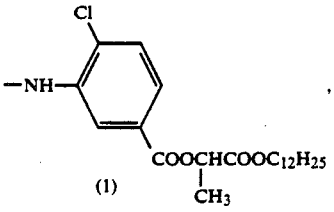
(1)
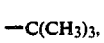
(2)
-continued
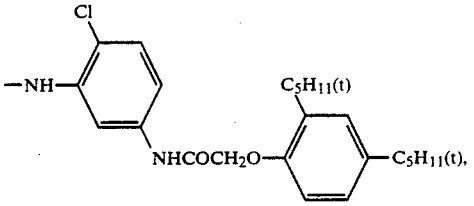
(3)
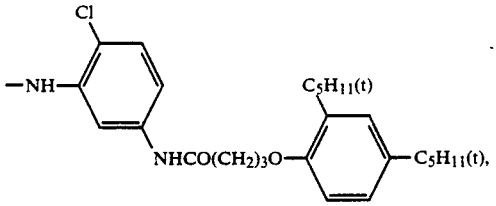
(4)
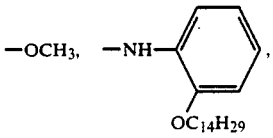
(5) (6)
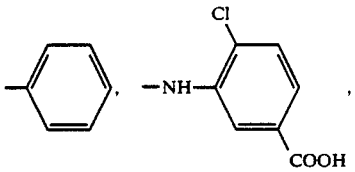
(7) (8)
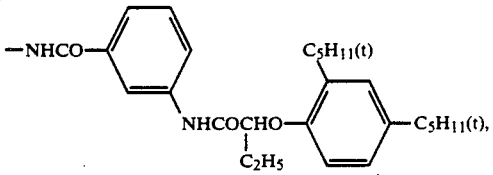
(9)
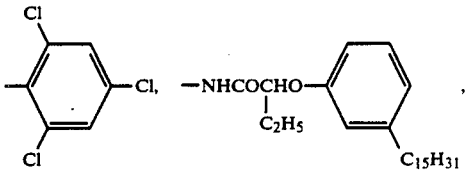
(10) (11)
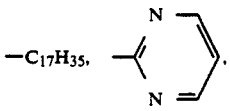
(12) (13)
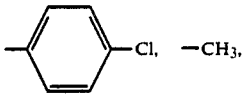
(14) (15)

-continued
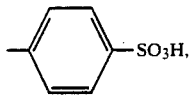
(16)
$-CONHC_{18}H_{37}$,
(17)
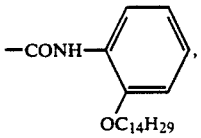
(18)
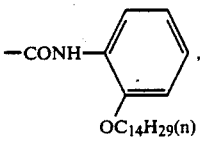
(19)
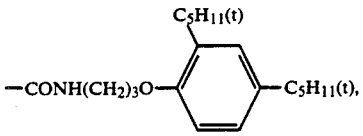
(20)
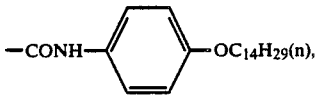
(21)
$-CONHCH_2CH_2COOH$
(22)
$-CONHCH_2CH_2COOCH_3$
(23)
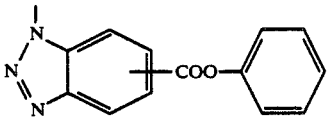
(30)
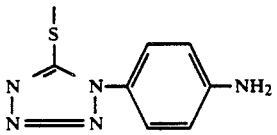
(31)
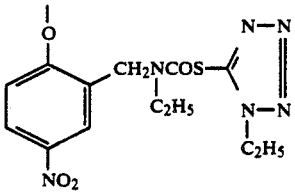
(32)
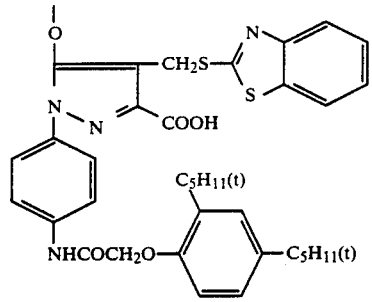
(33)
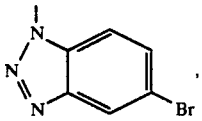
(34)
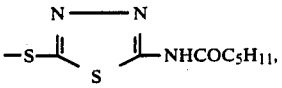
(35)
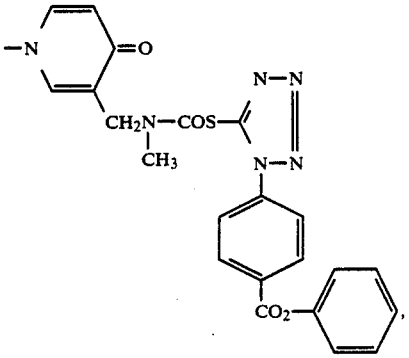
(36)
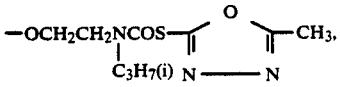
(37)
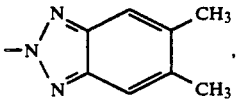
(38)
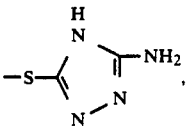
(39)
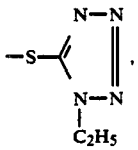
(40)
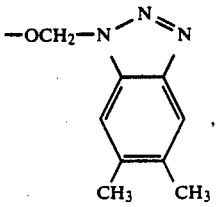
(41)

-continued
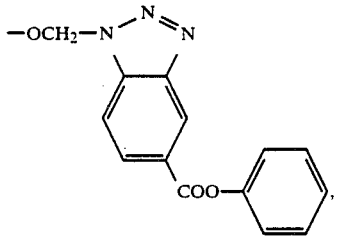
(42)
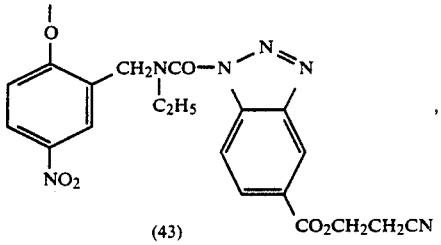
(43)
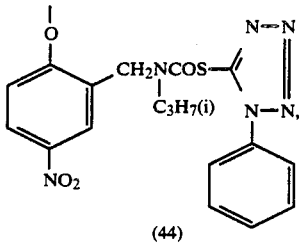
(44)
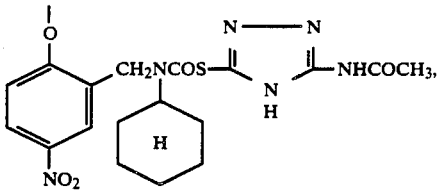
(45)
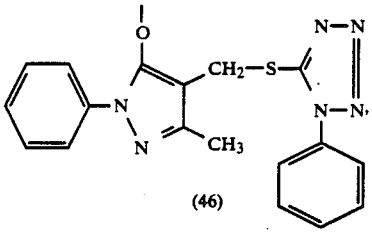
(46)
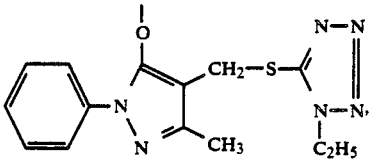
(47)
-continued
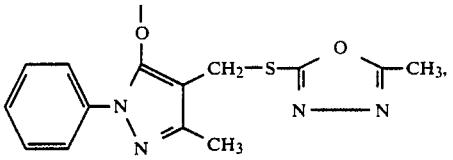
(48)
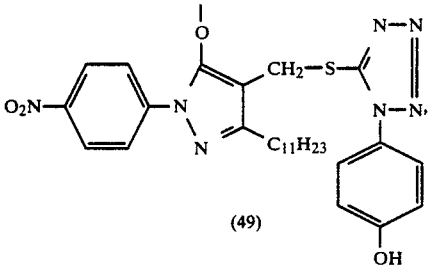
(49)
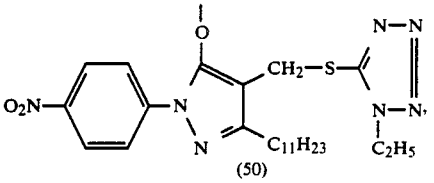
(50)
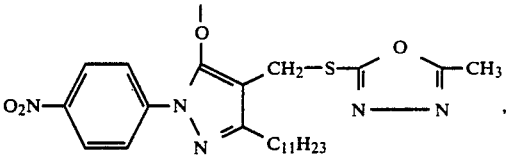
(51)
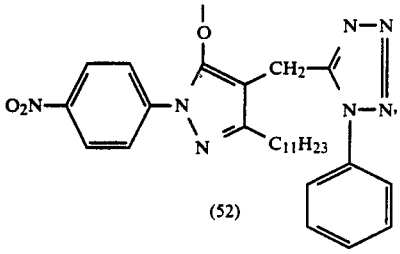
(52)
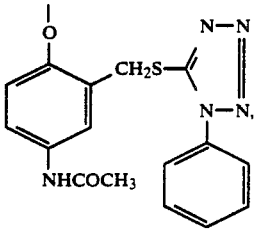
(53)

-continued

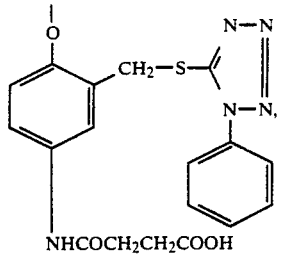

(54)

Including these examples, further examples of the diffusible DIR compound are described in U.S. Pat. Nos. 4,234,678, 3,227,554, 3,617,291, 3,958,993, 4,149,886 and 3,933,500, Japanese Patent O.P.I. Publication Nos. 56837/1982 and 13239/1976, U.S. Pat. Nos. 2,072,363 and 2,070,266, and Research Disclosure No. 21228 (Dec. 1981), and the like.

The silver halide light-sensitive color photographic material is suitably usable as a light-sensitive material for photographing use such as color negative film, color reversal film, and the like.

As the silver halide emulsion to be used in the light-sensitive material of this invention, any arbitrary one of ordinary silver halide emulsions may be used, and the emulsion may be chemically sensitized and further optically sensitized by using sensitizing dyes to be made sensitive to desired wavelength resions.

To the silver halide emulsion may be added an antifogging agent, a stabilizer, and the like, and as the binder of the emulsion, gelatin may be advantageously used.

Hydrophilic colloid layers to constitute the emulsion layers and other intermediate layers and the like may be hardened by using a hardener, and may also contain a plasticizer, a water-insoluble or less-soluble synthetic polymer-dispersed product (latex), and the like.

Further, into these layers may be incorporated a colored coupler having a color compensation effect, competitive coupler, and chemical materials which, by the coupling reaction with the oxidation product of a developing agent, releases photographically useful fragments such as development accelerator, developing agent, silver halide solvent, color-toning agent, hardener, fogging agent, antifoggant, chemical sensitizer, spectral sensitizer, desensitizing agent, and the like.

The light-sensitive material may be provided with auxiliary layers such as filter layers, antihalation layer, anti-irradiation layer, and the like. These layers and/or emulsion layers may also contain dyes which are to be dissolved out of the light-sensitive material or to be bleached during the development of the light-sensitive material. Also, to the light-sensitive material may be added matting agent, lubricant, image stabilizer, surfactant, anticolor-stain agent, development accelerator, development retarder, bleaching accelerator, and the like.

Materials usable as the support of the light-sensitive material include polyethylene, etc.-laminated paper, polyethylene terephthalate film, baryta paper, cellulose triacetate, and the like.

A dye image from the light-sensitive material of this invention may, after being imagewise exposed, be obtained by usual color photographic processing.

EXAMPLES

The present invention will be illustrated further in detail by the following examples, but the embodiment of this invention is not limited to and by the examples.

In all the following examples, the amount of the sensitizing dyes and couplers to be added to the silver halide light-sensitive photographic material will be indicated per mole of silver. The same shall apply even where nothing is stated. Also, the adding amount of other additives will be indicated per $m^2$. The same shall apply even where nothing is stated. And the amount of the silver halide and colloidal silver will be indicated in silver equivalent.

Example 1

On a triacetyl cellulose support were formed the following compositions-having layers in order from the support side, whereby a color light-sensitive color photographic material Sample No. 1 was prepared.

Sample No. 1 (Comparative)

Layer 1: Antihalation layer (HC-1)

A gelatin layer containing black colloidal silver. (Thickness: 1.5 μm)

Layer 2: Intermediate layer (I.L.)

A gelatin layer containing a dispersed product of 2,5-di-t-octylhydroquinone. (Thickness: 1.0 μm)

Layer 3: Low-speed red-sensitive silver halide emulsion layer (RL-1)

A monodisperse emulsion (Emulsion-I) comprising AgBrI having an average grain size ($\bar{r}$) of 0.42 μm, containing 7.2 mole % AgI . . . Coating amount of silver: 1.8 g/$m^2$
Sensitizing dye I . . . $5\times10^{-4}$ mole per mole of silver
Sensitizing dye II . . . $0.8\times10^{-4}$ mole per mole of silver
Cyan coupler (C-A) . . . 0.085 mole per mole of silver
Colored cyan coupler (CC-I) . . . mole per mole of silver
DIR compound (D'-1) . . . mole per mole of silver
DIR compound (D'-2) ...0.002 mole per mole of silver
(Thickness: 3.0 μm)

Layer 4: High-speed red-sensitive silver halide emulsion layer (RH-i)

A monodisperse emulsion (Emulsion-II) comprising AgBrI having an average grain size ($\bar{r}$) of 0.75 μm, containing 7.2 mole % AgI . . . Coating amount of silver: 1.3 g/$m^2$
Sensitizing dye I . . . $2.5\times10^{-4}$ mole per mole of silver
Sensitizing dye II . . . $0.8\times10^{-4}$ mole per mole of silver
Cyan coupler (C-B) . . . 0.02 mole per mole of silver
Colored cyan coupler (CC-1) . . . 0.0015 mole per mole of silver
(Thickness: 1.5 μm)

Layer 5: Intermediate layer (I.L.)

A gelatin layer similar to Layer 2. (Thickness: 1.5 μm)

Layer 6: Low-speed green-sensitive silver halide emulsion layer (GL-1

Emulsion-I . . . Coating amount of silver: 1.8 g/$m^2$
Sensitizing dye III . . . $2.0\times10^{-4}$ mole per mole of silver
Sensitizing dye IV . . . $1.0\times10^{-4}$ mole per mole of silver
Magenta coupler (M-A) . . . 0.12 mole per mole of silver Colored magenta coupler (CM-1) . . . 0.004 mole per mole of silver
DIR compound (W-1) . . . 0.002 mole per mole of silver.
(Thickness: 3.0 μm)

Layer 7: High-speed green-sensitive silver halide emulsion layer (GH-1)

Emulsion-II . . . Coating amount of silver: 1.5 g/m$^2$
Sensitizing dye III . . . $1.2\times10^{-4}$ mole per mole of silver
Sensitizing dye IV . . . $0.8\times10^{-4}$ mole per mole of silver
Magenta coupler (M-A) . . . 0.02 mole per mole of silver
Colored magenta coupler (CM-1) . . . 0.002 mole per mole of silver.
(Thickness: 2.5 μm)

Layer 8: Yellow filter layer (YC-1)

A gelatin layer containing a dispersed product of yellow colloidal silver and 2,5-di-t-octylhydroquinone. (Thickness: 1.5 μm)

Layer 9: Low-speed blue-sensitive silver halide emulsion layer (BL-1)

A monodisperse emulsion (Emulsion-III) comprising AgBrI having an average grain size of 0.48 μm, containing
6.0 mole % AgI . . . Coating amount of silver: 0.9 g/m$^2$
Sensitizing dye V . . . $1.3\times10^{-4}$ mole per mole of silver
Yellow coupler (Y-A) . . . 0.34 mole per mole of silver
(Thickness: 3.0 μm)

Layer 10: High-speed blue-sensitive silver halide emulsion layer (BH-1)

A monodisperse emulsion (Emulsion-IV) comprising AgBrI having an average grain size of 0.9 μm, containing
7.2 mole % AgI . . . Coating amount of silver: 0.6 g/m$^2$
Sensitizing dye V . . . $1.0\times10^{-4}$ mole per mole of silver
Yellow coupler (Y-A) . . . 0.16 mole per mole of silver
DIR compound (W-I) . . . 0.0015 mole per mole of silver
(Thickness: 2.0 μm)

Layer 11: First protective layer (Pro-1)

A gelatin layer containing ultraviolet absorbing agents UV-1 and UV-2. (Thickness: 1.0 μm)

Layer 12: Second protective layer (Pro-2)

A gelatin layer containing silver iodobromide (AgI: 2 mole % average grain size: 0.07 μm), coating amount of silver . . . 0.5 g/m$^2$, and polymethyl methacrylate particles (particle diameter: 1.5 μm). (Thickness: 0.5 μm) In addition to the above compositions, to each of the above layers were added gelatin hardeners (H-1) and (H-2) and a surface active agent.

The compounds that were incorporated into the above respective layers are as follows:

Sensitizing dye I: Anhydro-5,5'-dichloro-9-ethyl-3,3'-di-(3-sulfopropyl) thiacarbocyanine hydroxide
Sensitizing dye II: Anhydro-9-ethyl-3,3'-di-(3-sulfopropyl)-4,5,4',5'-dibenzothiacarbocyanine hydroxide
Sensitizing dye III: Anhydro-5,5'-diphenyl-9-ethyl-3,3'-di-(3-sulfopropyl) oxacarbocyanine hydroxide
Sensitizing dye IV: Anhydro-9-ethyl-3,3'-di-(3-sulfopropyl)5,6,5',6'-dibenzoxacarbocyanine hydroxide
Sensitizing dye V: Anhydro-3,3'-di-(3-sulfopropyl)-4,5-benzo5'-methoxythiacyanine hydroxide

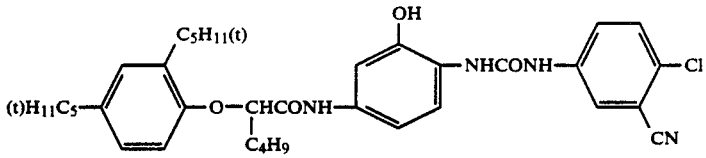

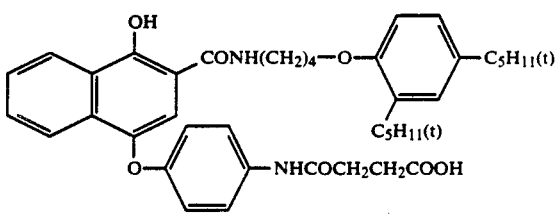

-continued
CC-1
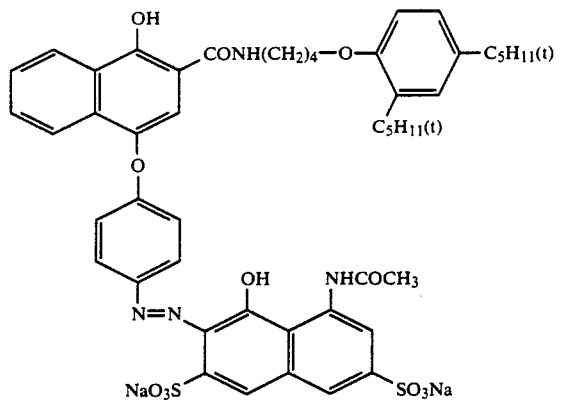
M-A
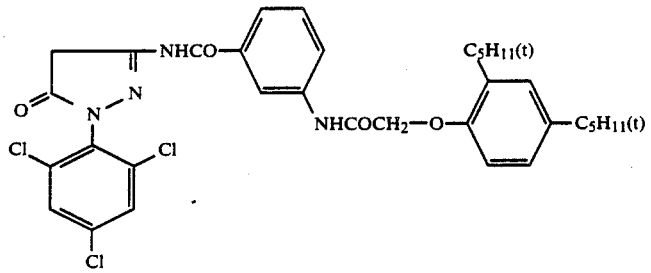
CM-1
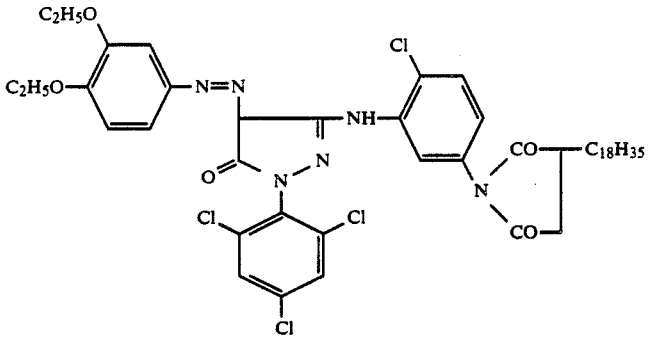
W-1
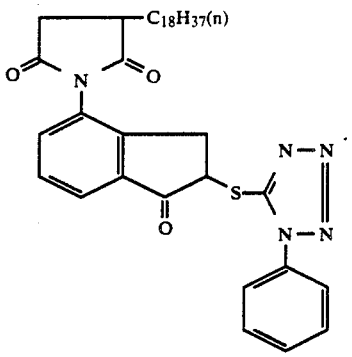

-continued

Y-A

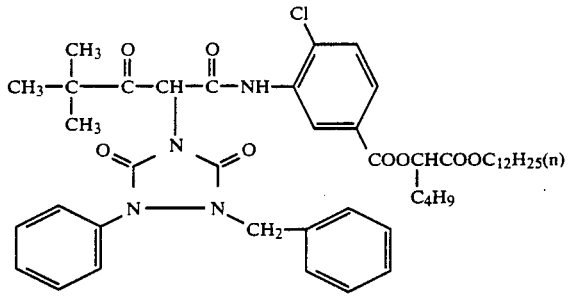

UV-1

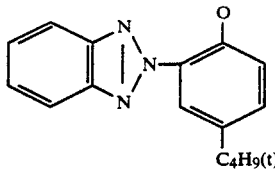

UV-2

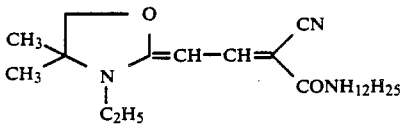

H-1

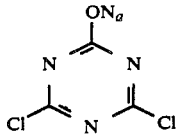

H-2

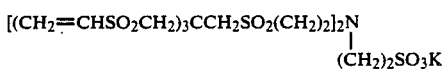

Subsequently, as is shown in the following Table-1, Samples No. 2 through No. 20 were prepared by modifying Sample No. 1: In samples No. 2 through No. 20, both the colorless coupler and the DIR compound only in the layers 3, 4, 6, 7, 9 and 10 of Sample No. 1 were changed according to Table-1, but the colored coupler and others were made remain the same as in Sample No. 1.

The thickness of each layer was adjusted by varying the coating amount of gelatin, but the thicknesses of those layers not shown in Table-1 are the same as in Sample No. 1.

In incorporating each of the DSR Nos. 9, 10, 12, 14, 21, 31 and 34 given in Table-1 into the hydrophilic colloid, the compound was used in the form of a dispersed liquid prepared in the manner that the compound was dissolved into the same weight thereas of a mixture of a high-boiling solvent (tricresyl phosphate) and ethyl acetate, and the solution was emulsifiedly dispersed along with a surface active agent and an aqueous gelatin solution by means of a colloid mill.

TABLE 1

| Sample No. | Dry layer thickness (μm) Layer 3 | Layer 4 | Layer 6 | Layer 7 | Layer 9 | Layer 10 | Whole layer |
|---|---|---|---|---|---|---|---|
| 1 | 3.0 | 1.5 | 3.0 | 2.5 | 3.0 | 2.0 | 22.0 |
| 2 | 2.0 | 1.0 | 2.0 | 1.5 | 2.5 | 1.0 | 17.0 |
| 3 | 3.0 | 1.5 | 3.0 | 2.5 | 3.0 | 2.0 | 22.0 |
| 4 | 2.0 | 1.0 | 2.0 | 1.5 | 2.5 | 1.0 | 17.0 |
| 5 | 2.0 | 1.0 | 2.0 | 1.5 | 2.5 | 1.0 | 17.0 |
| 6 | 2.0 | 1.0 | 2.0 | 1.5 | 2.5 | 1.0 | 17.0 |
| 7 | 3.0 | 1.5 | 3.0 | 2.5 | 3.0 | 2.0 | 22.0 |
| 8 | 2.0 | 1.0 | 2.0 | 1.5 | 2.5 | 1.0 | 17.0 |
| 9 | 2.0 | 1.0 | 2.0 | 1.5 | 2.5 | 1.0 | 17.0 |
| 10 | 2.0 | 1.0 | 2.0 | 1.5 | 2.5 | 1.0 | 17.0 |
| 11 | 2.0 | 1.0 | 2.0 | 1.5 | 2.5 | 1.0 | 17.0 |
| 12 | 2.0 | 1.0 | 2.0 | 1.5 | 2.5 | 1.0 | 17.0 |
| 13 | 2.0 | 1.0 | 2.0 | 1.5 | 2.5 | 1.0 | 17.0 |
| 14 | 2.0 | 1.0 | 2.0 | 1.5 | 2.5 | 1.0 | 17.0 |
| 15 | 2.0 | 1.0 | 2.0 | 1.5 | 2.5 | 1.0 | 17.0 |
| 16 | 1.2 | 0.5 | 1.5 | 0.9 | 2.0 | 0.7 | 13.7 |
| 17 | 1.2 | 0.5 | 1.5 | 0.9 | 2.0 | 0.7 | 13.7 |
| 18 | 1.2 | 0.5 | 1.5 | 0.9 | 2.0 | 0.7 | 13.7 |
| 19 | 1.2 | 0.5 | 1.5 | 0.9 | 2.0 | 0.7 | 13.7 |

TABLE 1-continued

| 20 | 1.2 | 0.5 | 1.5 | 0.9 | 2.0 | 0.7 | 13.7 |
|---|---|---|---|---|---|---|---|
| Sample No. | Amounts of couplers and compounds of invention added to the respective layers | | | | | | |
| | Layer 3 | Layer 4 | Layer 6 | Layer 7 | Layer 9 | Layer 10 | Remarks |
| 1 | C-A 0.085<br>W-1 0.002 | C-B 0.02 | M-A 0.12<br>W-1 0.002 | M-A 0.02 | Y-A 0.34 | Y-A 0.16 | Noninvention |
| 2 | C-A 0.085<br>W-1 0.002 | C-B 0.02 | M-A 0.12<br>W-1 0.002 | M-A 0.02 | Y-A 0.34 | Y-A 0.16 | Noninvention |
| 3 | C-A 0.085<br>W-1 0.002 | DSR-22 0.01<br>C-B 0.01 | M-A 0.12<br>W-1 0.002 | M-A 0.02 | Y-A 0.34 | Y-A 0.16 | Noninvention |
| 4 | C-A 0.085 | DSR-22 0.01<br>C-B 0.01 | M-A 0.12<br>W-1 0.002 | M-A 0.02 | Y-A 0.34 | Y-A 0.16 | Invention |
| 5 | C-A 0.08 | DSR-34 0.01<br>C-B 0.01 | M-A 0.12<br>W-1 0.002 | M-A 0.02 | Y-A 0.34 | Y-A 0.16 | Invention |
| 6 | DSR-35 0.03<br>C-A 0.05<br>W-1 0.002 | C-B 0.02 | M-A 0.12 | M-A 0.02 | Y-A 0.34 | Y-A 0.16 | Invention |
| 7 | C-A 0.08<br>W-1 0.002 | C-B 0.02 | M-A 0.12<br>W-1 0.002 | DSR-9 0.01<br>M-A 0.01 | Y-A 0.34 | Y-A 0.16 | Noninvention |
| 8 | C-A 0.08<br>W-1 0.02 | C-B 0.02 | M-A 0.12<br>W-1 0.002 | DSR-9 0.01<br>M-A 0.01 | Y-A 0.34 | Y-A 0.16 | Invention |
| 9 | C-A 0.08<br>W-1 0.002 | C-B 0.02 | M-A 0.12<br>W-1 0.002 | DSR-19 0.01<br>M-A 0.01 | Y-A 0.34 | Y-A 0.16 | Invention |
| 10 | C-A 0.08<br>W-1 0.002 | C-B 0.02 | DSR-3 0.03<br>M-A 0.09<br>W-1 0.02 | M-A 0.02 | Y-A 0.34 | Y-A 0.16 | Invention |
| 11 | C-A 0.08<br>W-1 0.002 | C-B 0.02 | M-4 0.09<br>W-1 0.002 | M-4 0.015 | Y-A 0.34 | Y-A 0.16 | Noninvention |
| 12 | C-A 0.08<br>W-1 0.002 | C-B 0.02 | M-4 0.09<br>W-1 0.002 | DSR-12 0.005<br>M-4 0.01 | Y-A 0.34 | Y-A 0.16 | Invention |
| 13 | C-A 0.08<br>W-1 0.002 | C-B 0.02 | M-2 0.09<br>W-1 0.002 | DSR-14 0.005<br>M-2 0.01 | Y-A 0.34 | Y-A 0.16 | Invention |
| 14 | C-A 0.08<br>W-1 0.002 | C-B 0.02 | M-2 0.09<br>W-1 0.002 | M-2 0.02 | Y-15 0.29 | Y-15 0.08 | Noninvention |
| 15 | C-A 0.08<br>W-1 0.002 | C-B 0.02 | M-2 0.09<br>W-1 0.002 | DSR-14 0.005<br>M-2 0.01 | Y-15 0.29 | Y-15 0.08 | Invention |
| 16 | C-A 0.08<br>W-1 0.002 | C-B 0.02 | M-2 0.09<br>W-1 0.002 | DSR-14 0.005<br>M-2 0.01 | Y-15 0.29 | Y-15 0.08 | Invention |
| 17 | C-A 0.08<br>W-1 0.002 | DSR-32 0.01<br>C-B 0.02 | M-2 0.09<br>W-1 0.002 | DSR-14 0.005<br>M-2 0.01 | Y-15 0.29 | Y-15 0.08 | Invention |
| 18 | C-A 0.08<br>D'-23 0.002 | C-B 0.02<br>D'-23 0.002 | M-2 0.09 | M-2 0.01 | Y-15 0.29 | Y-15 0.08 | Noninvention |
| 19 | C-A 0.08<br>D'-23 0.002 | DSR-32 0.01<br>C-B 0.01 | M-2 0.09<br>D'-23 0.002 | DSR-14 0.005<br>M-2 0.01 | Y-15 0.29 | Y-15 0.08 | Invention |
| 20 | C-A 0.08<br>D'-25 0.003 | DSR-32 0.01<br>C-B 0.01 | M-2 0.09<br>D'-23 0.003 | DSR-14 0.005<br>M-2 0.01 | Y-15 0.29 | Y-15 0.08 | Invention |

The thus prepared Samples No. 1 through No. 20 each was exposed through an wedge to white light and then processed in the following procedure steps:

| Processing Steps (at 38° C.) | |
|---|---|
| Color developing | 3 min. and 15 sec. |
| Bleaching | 6 min. and 30 sec. |
| Washing | 3 min. and 15 sec. |
| Fixing | 6 min. and 30 sec. |
| Washing | 3 min. and 15 sec. |
| Stabilizing | 1 min. and 30 sec. |
| Drying | |

The compositions of the processing solutions that were used in the respective processing steps are as follows:

| <Color Developer Solution> | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter. | |

-continued

| <Bleaching Bath> | |
|---|---|
| Iron-ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Water to make 1 liter. Use aqueous ammonia to adjust the pH to 6.0. | |
| <Fixer Bath> | |
| Ammonium thiosulfate | 175.0 g |
| Anhydrous sodium sulfite | 8.5 g |
| Sodium metasulfite | 2.3 g |
| Water to make 1 liter. Use acetic acid to adjust the pH to 6.0. | |

The obtained samples each was measured with respect to the relative speed, MTF and RMS values in accordance with the following procedure.

The relative speed is a relative value of the sensitivity found at the point of the minimum density +0.1 of each sample to that of Sample No. 1 regarded as 100.

As for the sharpness, the rectangular wave chart-photographed image density of each sample was measured by means of a SAKURA Microdensitometer Model PDM-5 Type AR (manufactured by Konishiroku Photo Industry Co., Ltd.) with its measuring head having a slit of a 300 μm×2 μm size to thereby obtain the MTF (Modulation Transfer Function) of each sample. This was indicated in a relative value of the MTF at the spatial frequency of 30 lines/mm of each sample to that of Sample No. 1 regarded as 100.

The RMS value was expressed in terms of a 1,000-fold value of the standard deviation of the density variation caused when scanning the density of the minimum density +0.7 by means of a microdensitometer having an scanning aperture area of 250$\mu m^2$.

Regarding the MTF and RMS values, their measurements were made for Samples No. 3 to No. 6 by using a red light alone, for Samples No. 7 through No. 16 by using a green light alone, and for the other samples by using both red and green lights. The obtained results are given in Table 2.

TABLE 2

| Sample No. | Relative speed | | Relative MTF | | RMS | | Remarks |
|---|---|---|---|---|---|---|---|
| | Green light | Red light | Green light | Red light | Green light | Red light | |
| 1 | 100 | 100 | 100 | 100 | 32 | 28 | Noninvention |
| 2 | 102 | 103 | 105 | 104 | 39 | 35 | Noninvention |
| 3 | 101 | 100 | — | 98 | — | 30 | Noninvention |
| 4 | 100 | 99 | — | 112 | — | 24 | Invention |
| 5 | 100 | 101 | — | 115 | — | 23 | Invention |
| 6 | 101 | 100 | — | 113 | — | 25 | Invention |
| 7 | 100 | 98 | 99 | — | 31 | — | Noninvention |
| 8 | 99 | 101 | 115 | — | 27 | — | Invention |
| 9 | 100 | 102 | 118 | — | 26 | — | Invention |
| 10 | 102 | 102 | 112 | — | 28 | — | Invention |
| 11 | 101 | 102 | 104 | — | 38 | — | Noninvention |
| 12 | 100 | 101 | 120 | — | 24 | — | Invention |
| 13 | 100 | 100 | 122 | — | 24 | — | Invention |
| 14 | 101 | 100 | 107 | — | 37 | — | Noninvention |
| 15 | 102 | 100 | 125 | — | 21 | — | Invention |
| 16 | 105 | 104 | 128 | — | 21 | — | Invention |
| 17 | 100 | 98 | 127 | 123 | 22 | 19 | Invention |
| 18 | 105 | 105 | 107 | 105 | 37 | 32 | Noninvention |
| 19 | 103 | 102 | 135 | 132 | 18 | 16 | Invention |
| 20 | 102 | 101 | 134 | 134 | 19 | 15 | Invention |

As is apparent from Table 1, the noninvention Sample No. 1 is a sample which does not meet the invention's requirements for both thickness and DSR compound, Samples No. 2, 11, 14 and 18 are samples which do not meet the invention's requirement for the DSR compound alone, Samples No. 3 and No. 7 are samples which do not meet the invention's requirement for the thickness alone, and the other samples are all for this invention.

According to the above Table 2 showing the measured results of the relative speed, sharpness (MTF) and granularity (RMS), by comparison of Sample No. 1 with Samples No. 3 and No. 7 which are the same in the thickness but differ only in the addition of the DSR compound, the DSR compound-added Samples No. 3 and No. 7 show their sensitivities being somewhat lowered, and this matches the conventionally known fact. Besides, they are recognized to tend to be deteriorated also in the granularity (RMS) as well as in the sharpness (MTF).

In addition, by comparison of Samples Nos. 2, 11, 14 and 18 whose thicknesses only were reduced without adding the DSR compound with Sample No. 1, they are found to be improved on both relative speed and sharpness (MTF) but deteriorated in the granularity (RMS). It is confirmed that this also matches the conventionally known fact.

In contrast, all the samples for this invention are obviously improved on the granularity (RMS) as well as on the sharpness (MTF) without having their sensitivities lowered. That is, the aforementioned effect of this invention can be obtained only in the case where the thickness of the light-sensitive material is not more than 18 $\mu m$, and the DSR compound is added to the light-sensitive material.

EXAMPLE-2

In this example, this invention was applied to a reversal light-sensitive material.

In the following description, as previously stated in the preceding example, the adding amount of the sensitizing dyes and couplers to the silver halide photographic material is indicated per mole of silver unless otherwise stated, and as for other additives, their adding amount is indicated per $m^2$ unless otherwise stated. And as for the silver halide and colloidal silver, their amount is indicated in silver equivalent.

On a subbed triacetyl cellulose film support were formed the following compositions-having layers in order from the support side, whereby a color light-sensitive color photographic material Sample No. 21 was prepared.

Sample No. 21

Layer 1: Antihalation layer (Thickness: 1.0 $\mu m$)

Ultraviolet absorbing agent UV-1 . . . 0.3 $g/m^2$
Ultraviolet absorbing agent UV-2 . . . 0.4 $g/m^2$
Black colloidal silver . . . 0.24$g/m^2$ Layer 2: Intermediate layer (Thickness: 0.9 $\mu m$)

2,5-di-t-octylhydroquinone . . . 0.1 $g/m^2$

Layer 3: Low-speed red-sensitive silver halide emulsion layer (Thickness: 2.6 $\mu m$)

A monodisperse emulsion (Emulsion-I') comprising AgBrI having an average grain size ($\bar{r}$) of 0.3 $\mu$, containing
4 mole % AgI. Coating amount of silver . . . 0.5 $g/m^2$
Sensitizing dye VI . . . $2.2\times10^{-4}$ mole
Sensitizing dye VII . . . $0.3\times10^{-4}$ mole
Coupler C-1 . . . 0.1 mole.

Layer 4: High-speed red-sensitive silver halide emulsion layer (Thickness: 3.0 $\mu m$)

A monodisperse emulsion (Emulsion-II') comprising AgBrI having an average grain size ($\bar{r}$)r of 0.75 $\mu$, containing
2.5 mole % AgI. Coating amount of silver . . . 0.8 $g/m^2$
Sensitizing dye VI . . . $8.8\times10^{-5}$ mole
Sensitizing dye VII . . . $1.2\times10^{-5}$ mole
Coupler C-i . . . 0.15 mole.

Layer 5: Intermediate layer (Thickness: 0.9 $\mu m$)

2,5-di-t-octylhydroquinone . . . 0.1 $g/m^2$.

Layer 6: Low-speed green-sensitive silver halide emulsion layer (Thickness: 2.5 $\mu m$)

Emulsion-I': Coating amount of silver . . . 0.9 $g/m^2$
Sensitizing dye VIII . . . $3.0\times10^{-4}$ mole
Sensitizing dye IX . . . $0.27\times10^{-4}$ mole
Coupler M-i . . . 0.06 mole.

Layer 7: High-speed green-sensitive silver halide emulsion layer (Thickness: 3.1 $\mu m$)

Emulsion-II': Coating amount of silver . . . 0.9 $g/m^2$
Sensitizing dye VIII . . . $1.2\times10^{-4}$ mole Sensitizing dye IX . . . $0.11\times10^{-4}$ mole
Coupler: Exemplified Magenta Coupler M-4 . . . 0.15 mole.

Layer 8: Intermediate layer (Thickness: 0.9 μm)

The same as layer 5.

Layer 9: Yellow filter layer (Thickness: 1.0 μm)

Yellow colloidal silver . . . 0.1 g/m²
2,5-di-t-octylhydroquinone . . . 0.1 g/m²

Layer 10: LOW-speed blue-sensitive silver halide emulsion layer (Thickness: 2.2 μm)

A monodisperse emulsion (Emulsion-III') comprising AgBrI having an average grain size ($\bar{r}$) of 0.6 μ, containing
2.5 mole % AgI: Coating amount of silver . . . 0.5 g/m²
Sensitizing dye X . . . $1.1\times10^{-4}$ mole
Coupler Y-A (the one used in Example 1) . . . 0.1 mole Layer 11: High-speed blue-sensitive silver halide emulsion layer (Thickness: 2.8 μm)

A monodisperse emulsion (Emulsion-IV') comprising AgBrI having an average grain size ($\bar{r}$) of containing
2.5 mole % AgI: Coating amount of silver . . . 0.8 g/m²
Sensitizing dye X . . . $6.6\times10^{-5}$ mole
Coupler Y-A (the same as above) . . . 0.23 mole Layer 12: First protective layer (Thickness: 1.1 μm)

Ultraviolet Absorbing Agent UV-I . . . 0.3 g/m²
Ultraviolet Absorbing Agent UV-2 . . . 0.4 g/m²
2,5-di-t-octylhydroquinone . . . 0.1 g/m²

Layer 13: Second protective layer (Thickness: 0.8 μm)

A non-light-sensitive fine-9rained silver halide emulsion comprising AgBrI having an average grain size ($\bar{r}$) 0 06 μ, containing 1 mole % AgI:
Coating amount of silver . . . g/m²

Polymethyl methacrylate particles (particle diameter of 1.5 μ) and Surface Active Agent S-1

In addition to the above compositions, to each of the layers were added Gelatin Hardeners H-1 and H-2 and a surface active agent. Further, tricresyl phosphate was used as the solvent for the above couplers, and dioctyl phthalate was used as the solvent for the 2,5-di-t-octylhydroquinone.

The compounds that were used for this sample are as follows:

UV-1: The same as the UV-1 that was used in Example-1.

UV-2: The same as the UV-2 that was used in Example-1.

Sensitizing Dye VI:

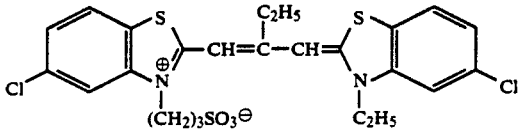

-continued

Sensitizing Dye VII:

The same as the Sensitizing Dye II that was used in Example-1.

Sensitizing Dye VIII:

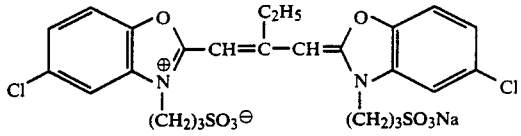

Sensitizing Dye IX:

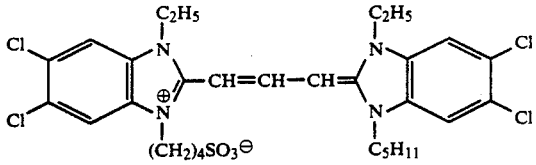

Sensitizing Dye X:

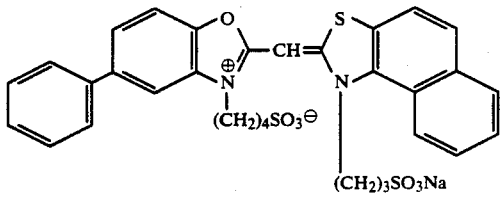

C-1

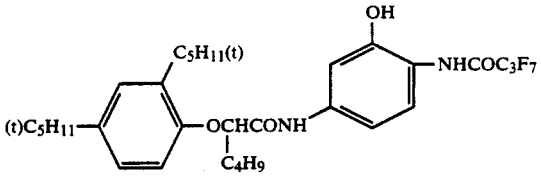

H-1:

The same as the H-1 that was used in Example-1.

H-2:

The same as the H-2 that was used in Example-1.

S-1:

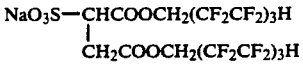

Subsequently, Samples No. 22 through No. 27 were prepared in the same manner as in Sample No. 21 except that the dry thicknesses of the layers of Sample No. 21 and the couplers contained in the layers were varied as shown in the following Table 3.

The thickness of each layer was adjusted by varying the coating amount of gelatin. The DSR compound was dispersed in the same manner as in Example-1, and then added.

TABLE 3

| Sample No. | Dry layer thickness (μm) Layer 3 | Layer 4 | Layer 6 | Layer 7 | Layer 10 | Layer 11 | Whole layer |
|---|---|---|---|---|---|---|---|
| 21 | 2.6 | 3.0 | 2.5 | 3.1 | 2.2 | 2.8 | 22.8 |

TABLE 3-continued

| | | | | | | | |
|---|---|---|---|---|---|---|---|
| 22 | 1.5 | 1.9 | 1.5 | 1.9 | 1.6 | 1.9 | 16.9 |
| 23 | 2.6 | 3.0 | 2.5 | 3.1 | 2.2 | 2.8 | 22.8 |
| 24 | 1.5 | 1.9 | 1.5 | 1.9 | 1.6 | 1.9 | 16.9 |
| 25 | 1.5 | 1.9 | 1.5 | 1.9 | 1.6 | 1.9 | 16.9 |
| 26 | 1.5 | 1.9 | 1.5 | 1.9 | 1.6 | 1.9 | 16.9 |
| 27 | 1.5 | 1.9 | 1.5 | 1.9 | 1.6 | 1.9 | 16.9 |

| Sample No. | Added amounts of couplers and compounds of invention to the respective layers | | | | | | Remarks |
|---|---|---|---|---|---|---|---|
| | Layer 3 | Layer 4 | Layer 6 | Layer 7 | Layer 10 | Layer 11 | |
| 21 | C-1 0.1 | C-1 0.15 | M-1 0.06 | M-1 0.15 | Y-1 0.1 | Y-1 0.23 | Noninvention |
| 22 | C-1 0.1 | C-1 0.15 | M-1 0.06 | M-1 0.15 | Y-1 0.1 | Y-1 0.23 | Noninvention |
| 23 | C-1 0.05<br>DSR-45 0.05 | C-1 0.10<br>DSR-45 0.05 | M-1 0.06 | M-1 0.15 | Y-1 0.1 | Y-1 0.23 | Noninvention |
| 24 | C-1 0.05<br>DSR-45 0.05 | C-1 0.10<br>DSR-45 0.05 | M-1 0.06 | M-1 0.15 | Y-1 0.1 | M-1 0.23 | Invention |
| 25 | C-1 0.05<br>DSR-45 0.05 | C-1 0.10<br>DSR-45 0.05 | M-1 0.04<br>DSR-43 0.02 | M-1 0.15 | Y-1 0.1 | Y-1 0.23 | Invention |
| 26 | C-1 0.05<br>DSR-46 0.05 | C-1 0.05<br>DSR-46 0.10 | M-1 0.04<br>DSR-43 0.02 | M-1 0.15 | Y-1 0.1 | Y-1 0.23 | Invention |
| 27 | C-1 0.05<br>DSR-49 0.05 | C-1 0.10<br>DSR-46 0.05 | M-1 0.06 | M-1 0.10<br>DSR-43 0.02 | Y-1 0.1 | Y-1 0.23 | Invention |

The thus prepared Samples No. 21 through No. 27 each was exposed through an optical wedge to white light and then processed in the following procedure steps:

| Processing step | Time | Temperature |
|---|---|---|
| First developing | 6 minutes | 38° C. |
| Washing | 2 minutes | 38° C. |
| Reversing | 2 minutes | 38° C. |
| Color developing | 6 minutes | 38° C. |
| Compensating | 2 minutes | 38° C. |
| Bleaching | 6 minutes | 38° C. |
| Fixing | 4 minutes | 38° C. |
| Washing | 4 minutes | 38° C. |
| Stabilizing | 1 minute | Normal temperature |
| Drying | | |

The compositions of the respective processing solutions that were used in the above procedure are as follows:

| | |
|---|---|
| <First Developer Solution> | |
| Sodium tetrapolyphosphate | 2.0 g |
| Sodium sulfite | 20.0 g |
| Hydroquinone monosulfonate | 30.0 g |
| Sodium carbonate, monohydrated | 30.0 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide (aqueous 0.1% solution) | 2.0 ml |
| Water to make 1 liter | |
| <Reversing Bath> | |
| Hexasodium nitrilotrimethylenesulfonate | 3.0 g |
| Stannous chloride, dihydrated | 1.0 g |
| p-Aminophenol | 0.1 g |
| Sodium hydroxide | 8.0 g |
| Glacial acetic acid | 15.0 ml |
| Water to make 1 liter | |
| <Color Developer Solution> | |
| Sodium tetrapolyphosphate | 2.0 g |
| Sodium sulfite | 7.0 g |
| Sodium tertiary phosphate, dihydrated | 36.0 g |
| Potassium bromide | 1.0 g |
| Potassium iodide (aqueous 0.1% solution) | 90.0 ml |
| Sodium hydroxide | 3.0 g |
| Citrazinic acid | 1.5 g |
| N-ethyl-N-β-methanesulfonamidoethyl-3-methyl-4-aminoaniline sulfate | 11.0 g |
| 2,2-ethylenedithiodiethanol | 1.0 g |
| Water to make 1 liter | |
| <Compensating Bath> | |
| Sodium sulfite | 12.0 g |

-continued

| | |
|---|---|
| Sodium ethylenediaminetetraacetate, dihydrated | 8.0 g |
| Thioglycerol | 0.4 ml |
| Glacial acetic acid | 3.0 ml |
| Water to make 1 liter | |
| <Bleaching Bath> | |
| Sodium ethylenediaminetetraacetate, dihydrated | 2.0 g |
| Iron (II)-ammonium ethylenediaminetetra-acetate, dihydrated | 120.0 g |
| Potassium bromide | 100.0 g |
| Water to make 1 liter | |
| <Fixer Bath> | |
| Ammonium thiosulfate | 80.0 g |
| Sodium sulfite | 5.0 g |
| Sodium hydrogensulfite | 5.0 g |
| Water to make 1 liter | |
| <Stabilizer Bath> | |
| Formalin (37% by weight) | 5.0 ml |
| Koniducks (product of Konishiroku Photo Industry Co., Ltd.) | 5.0 ml |
| Water to make 1 liter | |

The thus obtained samples each was measured with respect to the relative speed, MTF and RMS in the same manner as in Example 1, provided, however, in this example, every sample was measured with use of both green and red lights. The relative speed of each sample is indicated in the following table in a value of the reciprocal of the exposure giving a density of 1.0 relative to that of Sample No. 21 regarded as 100. As for the RMS, it measurement was made on a portion having a density of 1.0.

TABLE 4

| Sample No. | Relative speed | | Relative MTF | | RMS | | Remarks |
|---|---|---|---|---|---|---|---|
| | Green light | Red light | Green light | Red light | Green light | Red light | |
| 21 | 100 | 100 | 100 | 100 | 33 | 44 | Noninvention |
| 22 | 101 | 100 | 110 | 112 | 38 | 48 | Noninvention |
| 23 | 100 | 100 | 100 | 101 | 32 | 43 | Noninvention |
| 24 | 100 | 103 | 117 | 120 | 31 | 35 | Invention |
| 25 | 103 | 105 | 119 | 122 | 28 | 34 | Invention |
| 26 | 104 | 104 | 120 | 122 | 27 | 34 | Invention |
| 27 | 101 | 105 | 121 | 121 | 28 | 35 | Invention |

As is apparent from the above Table-4, the non-invention Sample No. 21 is a sample which does not meet the invention's requirements for both thickness and DSR compound. The sample, by reducing its thickness as in Sample No. 22, can be improved on the sharpness but is deteriorated in the granularity. The addition of the DSR compound alone to Sample No. 21 cannot improve the sample on its sharpness as in Sample No. 23, and can hardly show its effect of improving the granularity. In contrast, Samples Nos. 24, 25, 26 and 27, which satisfy all the invention's requirements, show that their granularity and sharpness are synergistically improved. Accordingly, the present invention, when applied to reversal light-sensitive materials, is significantly effective in improving their granularity and sharpness.

What is claimed is:

1. A silver halide light-sensitive color photographic material comprising a support having component layers thereof, said component layers comprising a red-sensitive silver halide emulsion layer, a green-sensitive silver halide emulsion layer, a blue-sensitive silver halide emulsion layer, one of said component layers being furthest from said support and having an uppermost surface facing away from said support, one of said silver halide emulsion layers being nearest said support and having a lowermost surface facing said support, a dry thickness from said uppermost surface to said lowermost surface being not more than 15 μm, at least one of said component layers containing a coupler of Formula Formula Coup—SC wherein Coup— is a coupler residue capable of releasing SC from a coupling position upon reaction with an oxidized product of a color development agent, and SC is scavenger which, after being released from Coup—, is capable of reducing said oxidized product, said scavenger containing a heterocyclic group having at least two substituents selected from the group consisting of —OH, —$NHSO_2R$, —$NH_2$, —NHR, and —NRR', in which R and R' are individually alkyl, cycloalkyl, alkenyl, or aryl.

2. The silver halide light-sensitive color photographic material of claim 1, wherein said coupler is contained in a silver halide emulsion layer.

3. The silver halide light-sensitive color photographic material of claim 2, wherein said an amount of said coupler is 0.0005 mol to 5.0 mol per mol of silver halide contained in said silver halide emulsion layer.

4. The silver halide light-sensitive color photographic material of claim 3, wherein an amount of said coupler is 0.005 mol to 1.0 mol per mol of silver halide contained said silver halide emulsion layer.

* * * * *